US010845751B2

(12) United States Patent
Hosoi et al.

(10) Patent No.: US 10,845,751 B2
(45) Date of Patent: Nov. 24, 2020

(54) IMAGE FORMING APPARATUS INCLUDING OPTICAL PRINT HEAD

(71) Applicant: CANON KABUSHIKI KAISHA, Tokyo (JP)

(72) Inventors: Shinichiro Hosoi, Tokyo (JP); Hitoshi Iwai, Abiko (JP); Yuya Tamura, Tsukuba (JP); Takehiro Ishidate, Tokyo (JP); Toshiki Momoka, Tokyo (JP); Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/683,545

(22) Filed: Nov. 14, 2019

(65) Prior Publication Data

US 2020/0081392 A1 Mar. 12, 2020

Related U.S. Application Data

(62) Division of application No. 16/166,511, filed on Oct. 22, 2018, now Pat. No. 10,503,115.

(30) Foreign Application Priority Data

Oct. 27, 2017 (JP) ..... 2017-208425

(51) Int. Cl.

| | |
|---|---|
| ***G03G 21/00*** | (2006.01) |
| ***G03G 21/10*** | (2006.01) |
| ***G03G 15/04*** | (2006.01) |

(52) U.S. Cl.

CPC ..... *G03G 21/10* (2013.01); *G03G 15/04036* (2013.01); *G03G 15/04054* (2013.01); *G03G 21/00* (2013.01)

(58) Field of Classification Search

CPC .. G03G 21/10; G03G 21/00; G03G 15/04036; G03G 15/04054

See application file for complete search history.

(56) References Cited

U.S. PATENT DOCUMENTS 7,903,994 B2 * 3/2011 Matsumoto ..... G03G 21/1825 399/110
8,107,847 B2 * 1/2012 Kawai ..... G03G 15/04054 399/98

(Continued)

FOREIGN PATENT DOCUMENTS

JP 2007-072321 A 3/2007
JP 2007-168297 A 7/2007

OTHER PUBLICATIONS

Extended European Search report dated Mar. 1, 2019, in European Patent Application No. 18199906.1.

*Primary Examiner* — Hoang X Ngo
(74) *Attorney, Agent, or Firm* — Venable LLP

(57) ABSTRACT

An image forming apparatus includes a drum cartridge including a photosensitive drum, a movable optical print head including a light emitting element and a lens array, and a portion-to-be-contacted. The photosensitive drum and a light emergent surface of the lens array are spaced from each other to permit insertion of a cleaning member therebetween from an outside of the main assembly. The portion-to-be-contacted provided in a main assembly and configured to be contacted by the cleaning member to prevent further insertion of said cleaning member after said cleaning member cleans said light emergent surface by sliding on the light emergent surface from one end side toward the other end side of the light emergent surface with respect to a longitudinal direction of said lens array.

23 Claims, 16 Drawing Sheets

(56) References Cited

U.S. PATENT DOCUMENTS

| | | | | |
|---|---|---|---|---|
| 8,879,930 | B2 * | 11/2014 | Mori | G03G 15/55 399/34 |
| 9,454,124 | B2 * | 9/2016 | Takasaka | G03G 15/04036 |
| 2009/0087210 | A1 | 4/2009 | Terao et al. | |
| 2010/0329727 | A1 | 12/2010 | Ashida et al. | |
| 2015/0331382 | A1 | 11/2015 | Takasaka et al. | |

* cited by examiner (a)

(b)

(a)

(b)

(a)

(b)

(a)

(b)

(a)

(b)

IMAGE FORMING APPARATUS INCLUDING OPTICAL PRINT HEAD

FIELD OF THE INVENTION AND RELATED ART

The present invention relates to an image forming apparatus including a cleaning mechanism for cleaning a lens of an optical print head.

In image forming apparatuses such as a printer and a copying machine, there is an image forming apparatus provided with a plurality of light emitting elements for exposing a photosensitive drum to light. The optical print head includes an LED (light emitting diode), an organic EL (electro-luminescence) device or the like as an example of a light emitting element (device), and an optical print head in which the light emitting elements are arranged along a rotational axis direction of the photosensitive drum in a row (line) or in two rows (lines) with a staggered pattern has been known. Further, the optical print head includes a plurality of lenses for focusing light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum. The light beams emitted from the plurality of light emitting elements are focused on the surface of the photosensitive drum through the lenses. As a result, an electrostatic latent image is formed on the surface of the photosensitive drum. In order to form a good image on the photosensitive drum surface, there is a need that an interval (gap) between the photosensitive drum surface and light emergent surfaces of the lenses is determined with accuracy so that position of the light beams focused by the lenses is on the photosensitive drum surface.

The photosensitive drum is one of consumables, and therefore is exchanged periodically. For that reason, an exchange unit including the photosensitive drum is constituted so as to be mountable to and dismountable from an image forming apparatus main assembly. An operator such as a user or service person can perform maintenance of the image forming apparatus by exchanging the exchange unit with a new exchange unit by extracting the exchange unit from the apparatus main assembly and then inserting the new exchange unit into the apparatus main assembly. During exchange of the exchange unit, in order to prevent contact of a part (for example, the photosensitive drum) of the exchange unit to the optical print head, the exchange unit and the optical print head are spaced from each other with a certain distance (exchanging position). On the other hand, during image formation, the optical print head is positioned near the exchange unit (exposure position). In general, an image forming apparatus including a moving mechanism for moving the optical print head between the exchanging position and the exposure position has been known.

In the image forming apparatus, an exposure device such as the optical print head is provided between a charging device and a developing device in some instances. In order to realize downsizing of the image forming apparatus, it is effective to minimize distances among the photosensitive drum, the optical print head, the charging device, the developing device and the like. For this reason, there was a problem that the light emergent surfaces of the lenses are contaminated with toner falling from the photosensitive drum and the developing device. There is a possibility that the light beams emitted from the light emitting elements are partly blocked by a contaminant (toner) on the light emergent surfaces of the lenses, so that the contaminant is one of factors causing a lowering in image quality of an output image. Therefore, a cleaning means for preventing generation of the contaminant on the lenses causing the lowering in image quality has been proposed. As an example of the cleaning means, for example, Japanese Laid-Open Patent Application (JP-A) 2007-72321 discloses the following cleaning means.

JP-A 2007-72321 discloses an LED print head (LPH) 30 in which a cleaning mechanism 80 is mounted on a head body 31. The cleaning mechanism 80 includes a cleaning pad 80B, at a lower end of an operating rod 80A, for cleaning an upper surface (light emergent surface 38) of a rod lens array 33. Further, at a lower end of the operating rod 80A, an engaging portion 82 is engaged with the head body 31. The engaging portion 82 includes arm portions 82A formed on left and rear sides so as to vertically extend. Inside free end portions of the arm portions 82A, engaging projections 82B are provided so as to project inwardly. The engaging projections 82B are loosely engaged with guide grooves 37 formed in side surfaces of the head body 31 and thus are mounted to the head body 31. On a rear end side (front side) of the operating rod 80B, an operating portion 83 for gripping the cleaning mechanism 80 by an operator is formed. The operator grips the operating portion 83 and operates (pulls (extracts) and pushes (inserts)) the cleaning mechanism 80 mounted on the head body 31. As a result, the cleaning mechanism 80 is moved along the guide grooves 37 in a state in which the engaging projects 82B are loosely engaged with the guide grooves 37. By the above constitution, the operator can clean the light emergent surface 38 of the rod lens array 33.

However, in the LPH 30 disclosed in JP-A 2007-72321, when the operator operates the cleaning mechanism 80, the following problem arises. When the cleaning mechanism 80 disclosed in JP-A 2007-72321 is moved from a front side toward a rear side of the image forming apparatus main assembly by the operator, the engaging projections 82B contact edges of the guide grooves 37 of the head body 31 on a rear end side (rear side). In this mechanism, there is a liability that the head body 31 is moved by impact when the cleaning member 80 contacts the head body 31. For that reason, there is a liability that a position of the head body 31, moved to the exposure position, relative to the photosensitive drum is deviated from a predetermined position (i.e., causes positional deviation).

In a method in which the LPH 30 is used for exposure of the photosensitive drum, during image formation, there is a need that the rod lens array 33 is positioned relative to the photosensitive drum at a predetermined position with accuracy. For that reason, the position deviation of the head body 31 relative to the head body 31 can constitute one of factors causing improper image formation.

As regards the cleaning mechanism for the optical print head, a mechanism which contacts a drum unit including a photosensitive drum when the operator inserts a cleaning member (corresponding to the cleaning mechanism 80) from an outside into an image forming apparatus main assembly also exists. However, in this mechanism, there is a liability that the drum unit is moved by impact when the cleaning member contacts the drum unit. Due to deviation of a position of the drum unit relative to the photosensitive drum, a possibility of occurrence of improper image formation is not negligible.

As a result, it is hard to say that the mechanism, in which the cleaning member inserted from the outside of the apparatus main assembly by the operator contacts the optical print head body (head body 31) or the drum unit, is an optimum mechanism for realizing high definition (precision) of an image quality.

SUMMARY OF THE INVENTION

According to an aspect of the present invention, there is provided an image forming apparatus comprising: a drum cartridge including a photosensitive drum and capable of being exchanged by being mounted in and dismounted from a main assembly; an optical print head including a light emitting element configured to emit light to which the photosensitive drum is exposed and including a lens array configured to focus the light onto the photosensitive drum, wherein the optical print head is movable between an exposure position where the photosensitive drum is exposed to the light by causing the light emitting element to emit the light in a state in which the optical print head is positioned relative to the drum cartridge, and an exchanging position where the optical print head is released from the positioning to permit exchange of the drum cartridge; and wherein the photosensitive drum and a light emergent surface of the lens array are spaced from each other to permit insertion of a cleaning member therebetween from an outside of the main assembly; and a portion-to-be-contacted provided in the main assembly and configured to be contacted by the cleaning member to prevent further insertion of the cleaning member after the cleaning member cleans the light emergent surface by sliding on the light emergent surface from one end side toward the other end side of the light emergent surface with respect to a longitudinal direction of the lens array.

According to another aspect of the present invention, there is provided an image forming apparatus comprising: a drum cartridge including a photosensitive drum and capable of being exchanged by being mounted in and dismounted from a main assembly; an optical print head including a light emitting element configured to emit light to which the photosensitive drum is exposed and including a lens array configured to focus the light onto the photosensitive drum, wherein the optical print head is movable between an exposure position where the photosensitive drum is exposed to the light by causing the light emitting element to emit the light in a state in which the optical print head is positioned relative to the drum cartridge, and a retracted position retracted from the drum cartridge further than the exposure position is; and wherein the photosensitive drum and a light emergent surface of the lens array are spaced from each other to permit insertion of a cleaning member therebetween from an outside of the main assembly; and a portion-to-be-contacted provided in the main assembly and configured to be contacted by the cleaning member to prevent further insertion of the cleaning member after the cleaning member cleans the light emergent surface in a light passing region where the light focused in a region used for forming an image on the photosensitive drum passes.

According to a further aspect of the present invention, there is provided an image forming apparatus comprising: a main assembly; a drum cartridge including a photosensitive drum and capable of being exchanged by being mounted in and dismounted from the main assembly; an optical print head including a light emitting element configured to emit light to which the photosensitive drum is exposed and including a lens array configured to focus the light onto the photosensitive drum, the optical print head being movable between an exposure position where the photosensitive drum is exposed to the light by causing the light emitting element to emit the light in a state in which the optical print head is positioned to the drum cartridge and a recording paper retracted from the photosensitive drum further than the exposure position is; and a bar like cleaning member configured to clean a light emergent surface of the lens array, wherein the cleaning member includes a grip portion provided on one end side of the cleaning member with respect to a longitudinal direction of the cleaning member and configured to be gripped, a slidable portion provided on the other end side of the cleaning member with respect to the longitudinal direction of the cleaning member and configured clean the light emergent surface by sliding on the light emergent surface, and a contact portion configured to contact a portion to be contacted fixed to the main assembly as a separate member from the optical print head and the drum cartridge so that the slidable portion inserted from an outside of the main assembly toward between the photosensitive drum and the light emergent surface and cleaning the light emergent surface by sliding on the light emergent surface is prevented from further moving toward a downstream side with respect to an inserting direction thereof.

Further features of the present invention will become apparent from the following description of exemplary embodiments with reference to the attached drawings.

BRIEF DESCRIPTION OF THE DRAWINGS

Parts (a) and (b) of FIG. 1 are schematic sectional views each showing an image forming apparatus.

Parts (a) and (b) of FIG. 2 are schematic perspective views showing a drum unit and a periphery thereof in the image forming apparatus.

Figure 4:
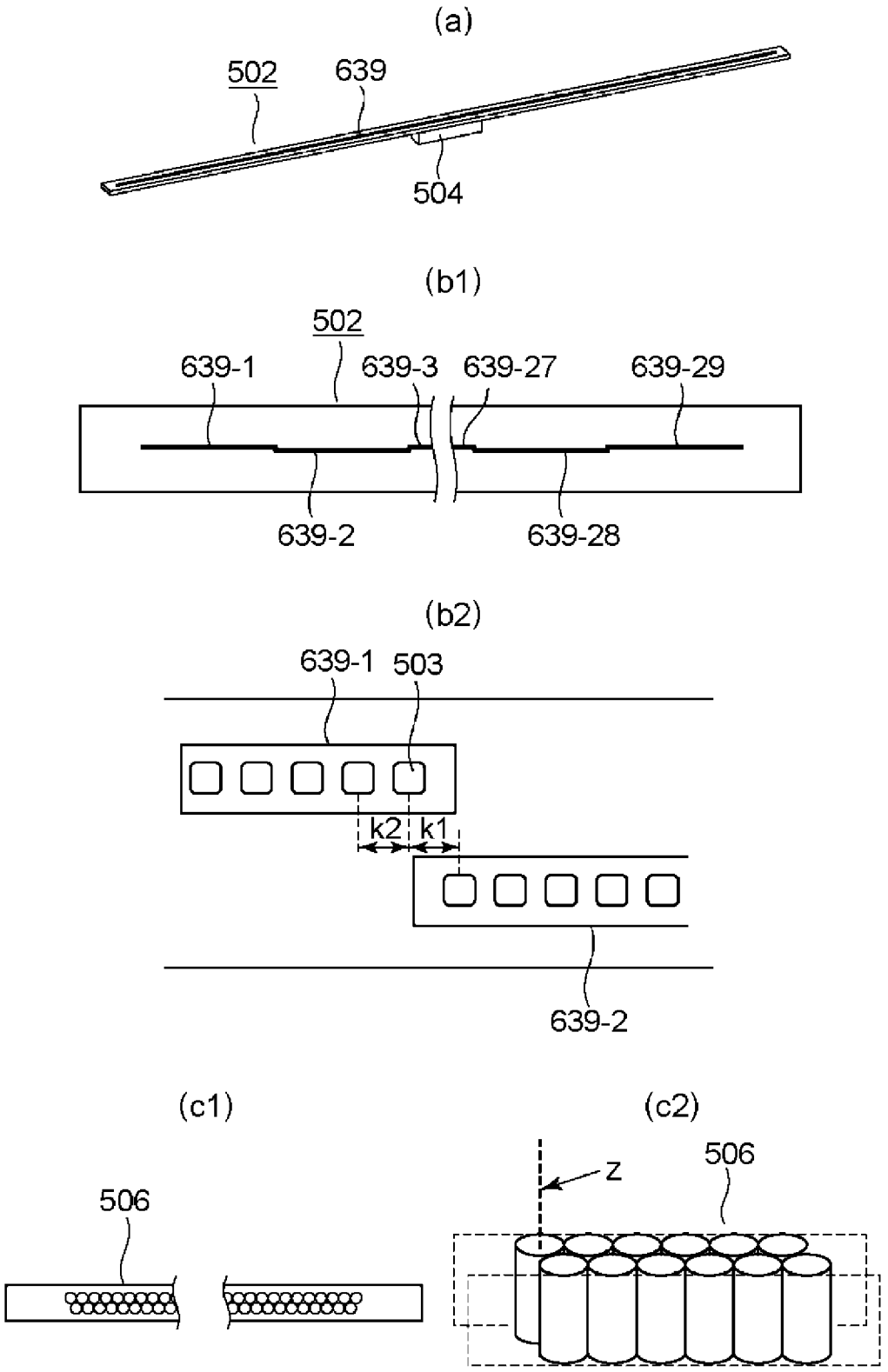

Parts (a), (b1), (b2), (c1) and (c2) of FIG. 4 are schematic views for illustrating a substrate, an LED chip or a lens array of an optical print head.

Figure 5:
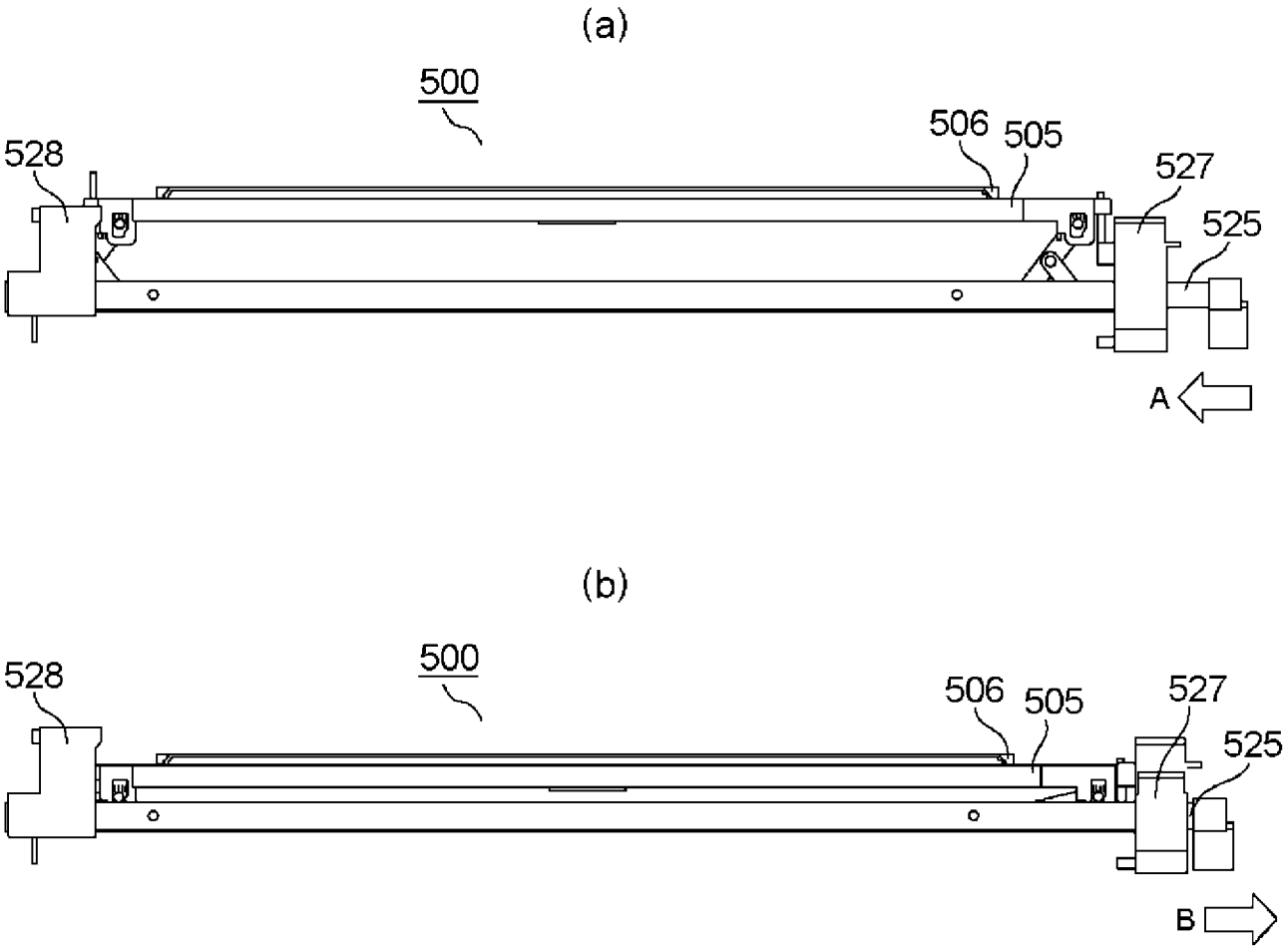

Parts (a) and (b) of FIG. 5 are side views of the optical print head.

Figure 6:
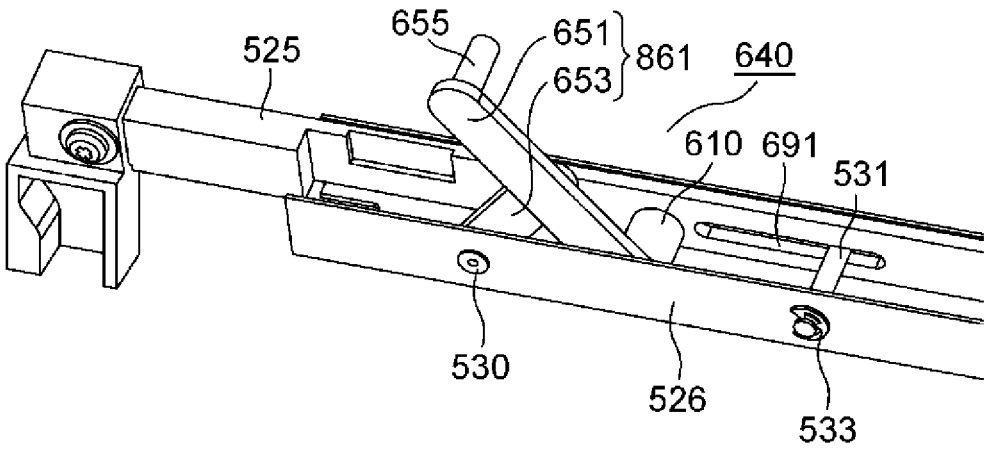
Figure 6:
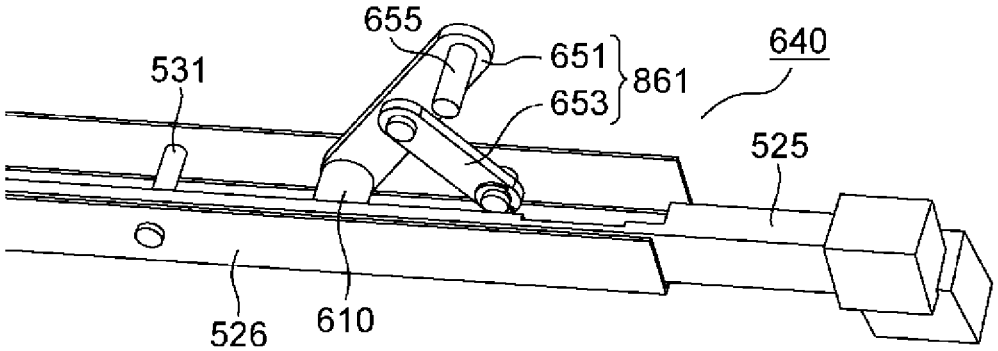

Parts (a) and (b) of FIG. 6 are perspective views of a moving mechanism.

Figure 7:
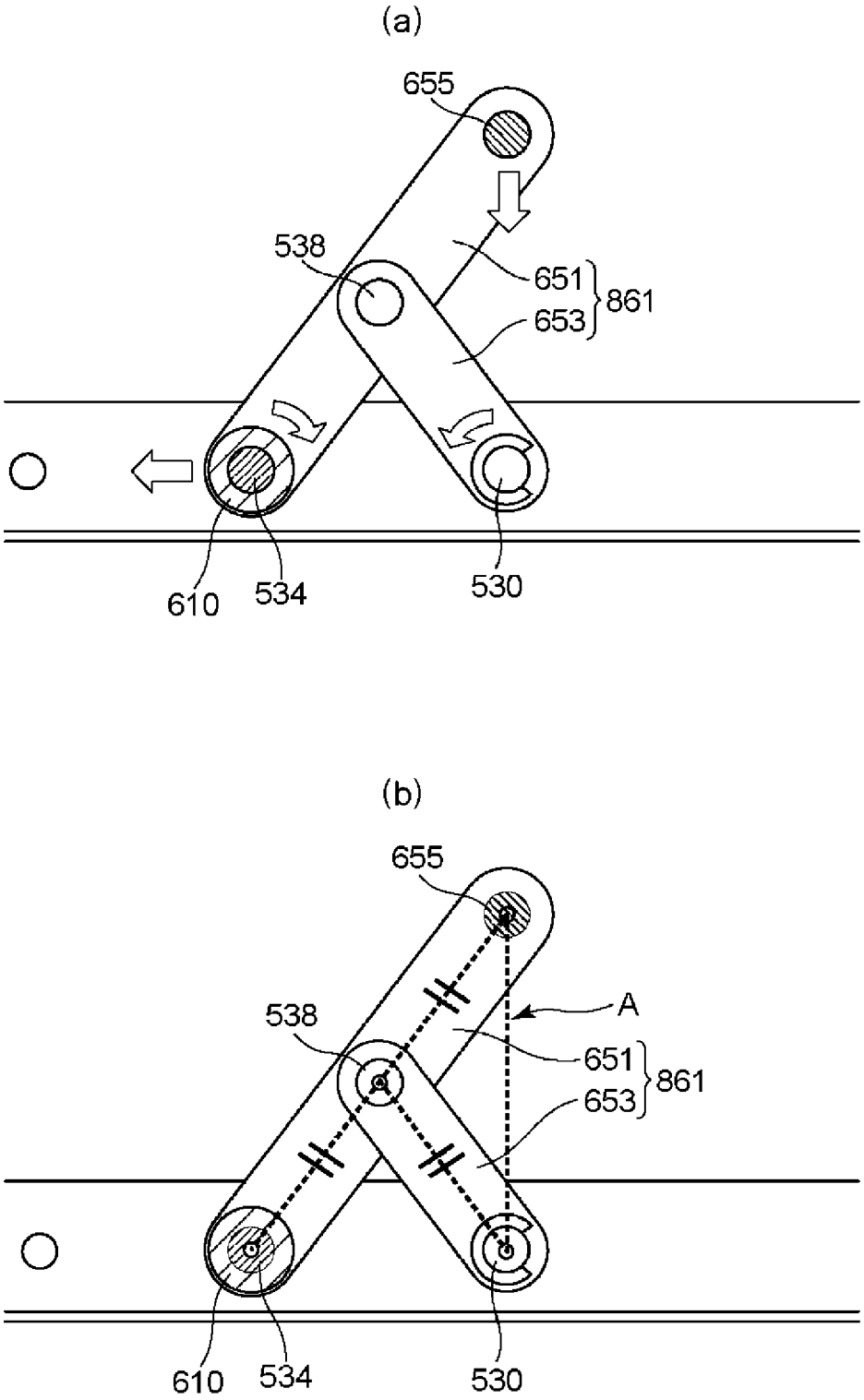

Parts (a) and (b) of FIG. 7 are side views of a first link mechanism of λ type.

Figure 8:
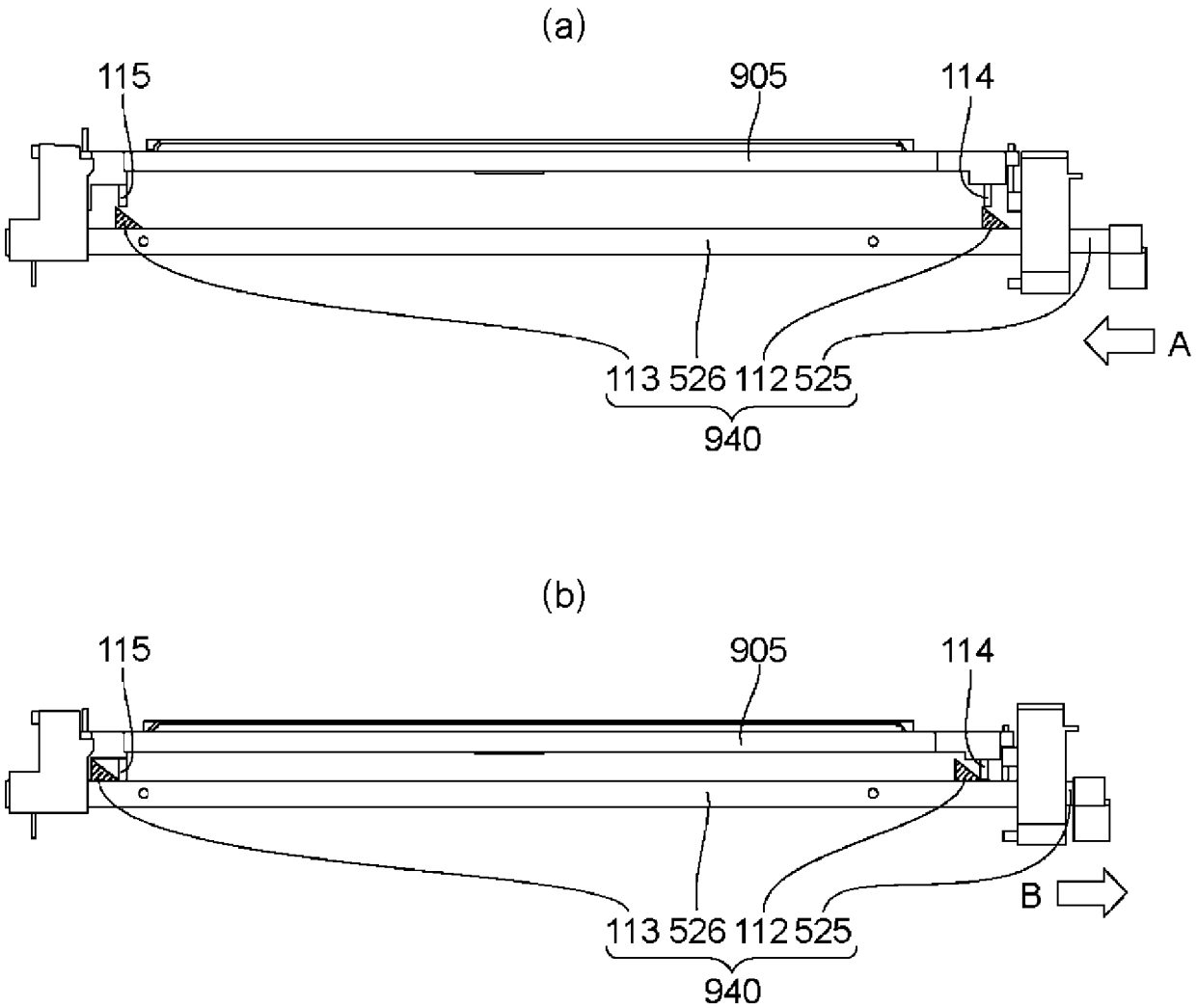

Parts (a) and (b) of FIG. 8 are schematic views for illustrating the moving mechanism using a cam mechanism.

Figure 9:
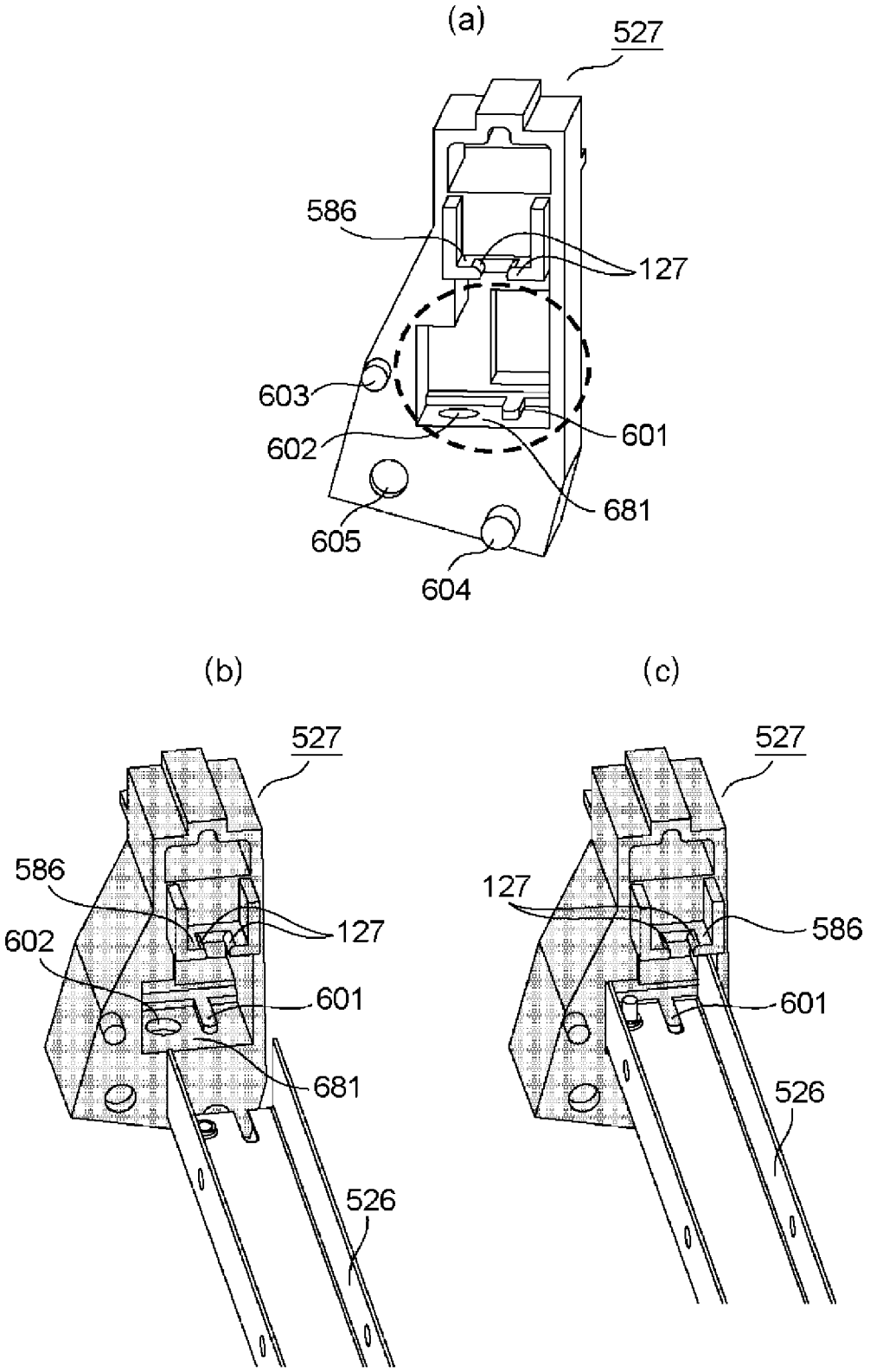

Parts (a), (b) and (c) of FIG. 9 are perspective views of a first supporting portion and a third supporting portion.

Figure 10:
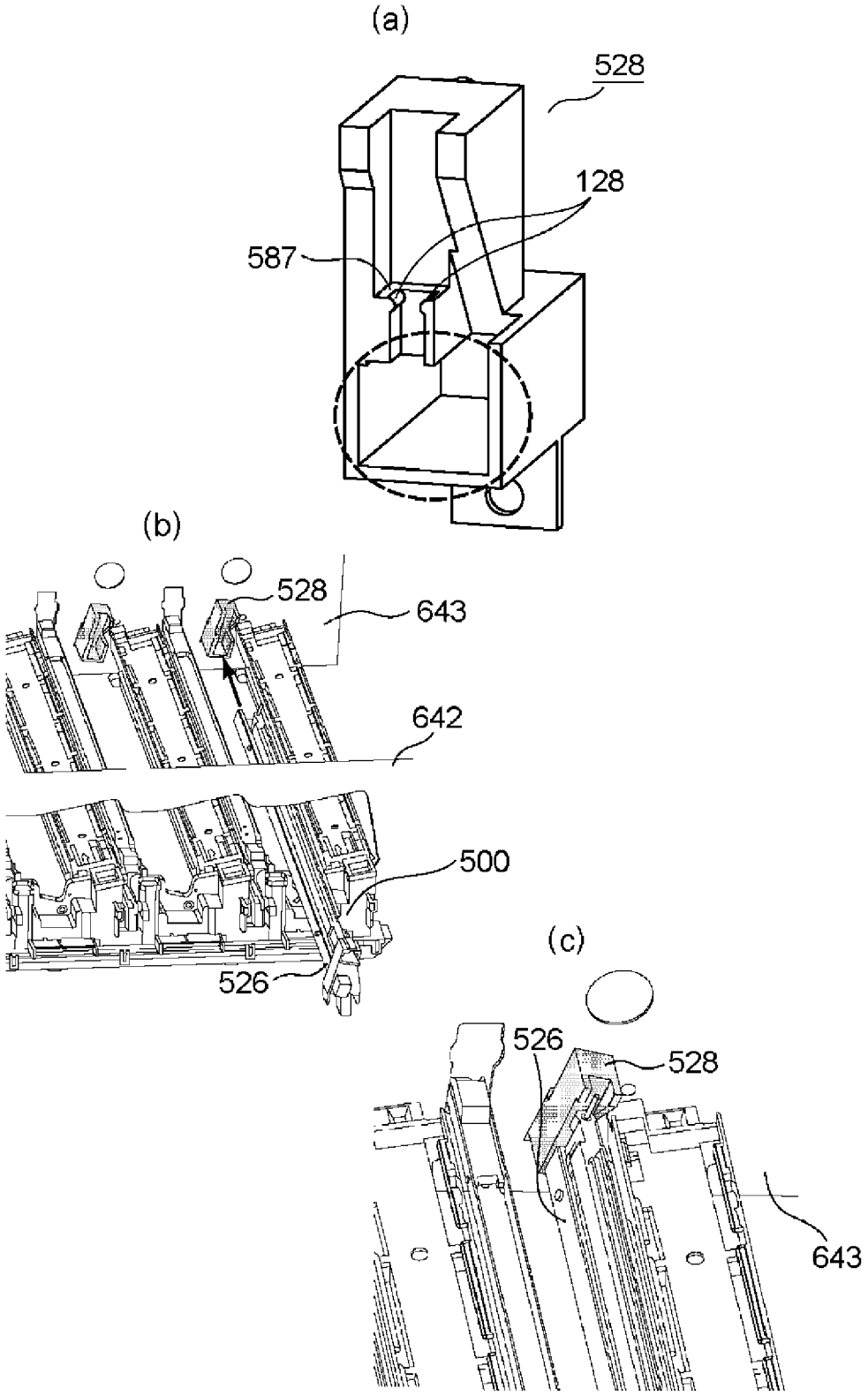

Parts (a), (b) and (c) of FIG. 10 are perspective views of a second supporting portion, a rear side plate and an exposure unit mounted on the second supporting portion.

Figure 11:
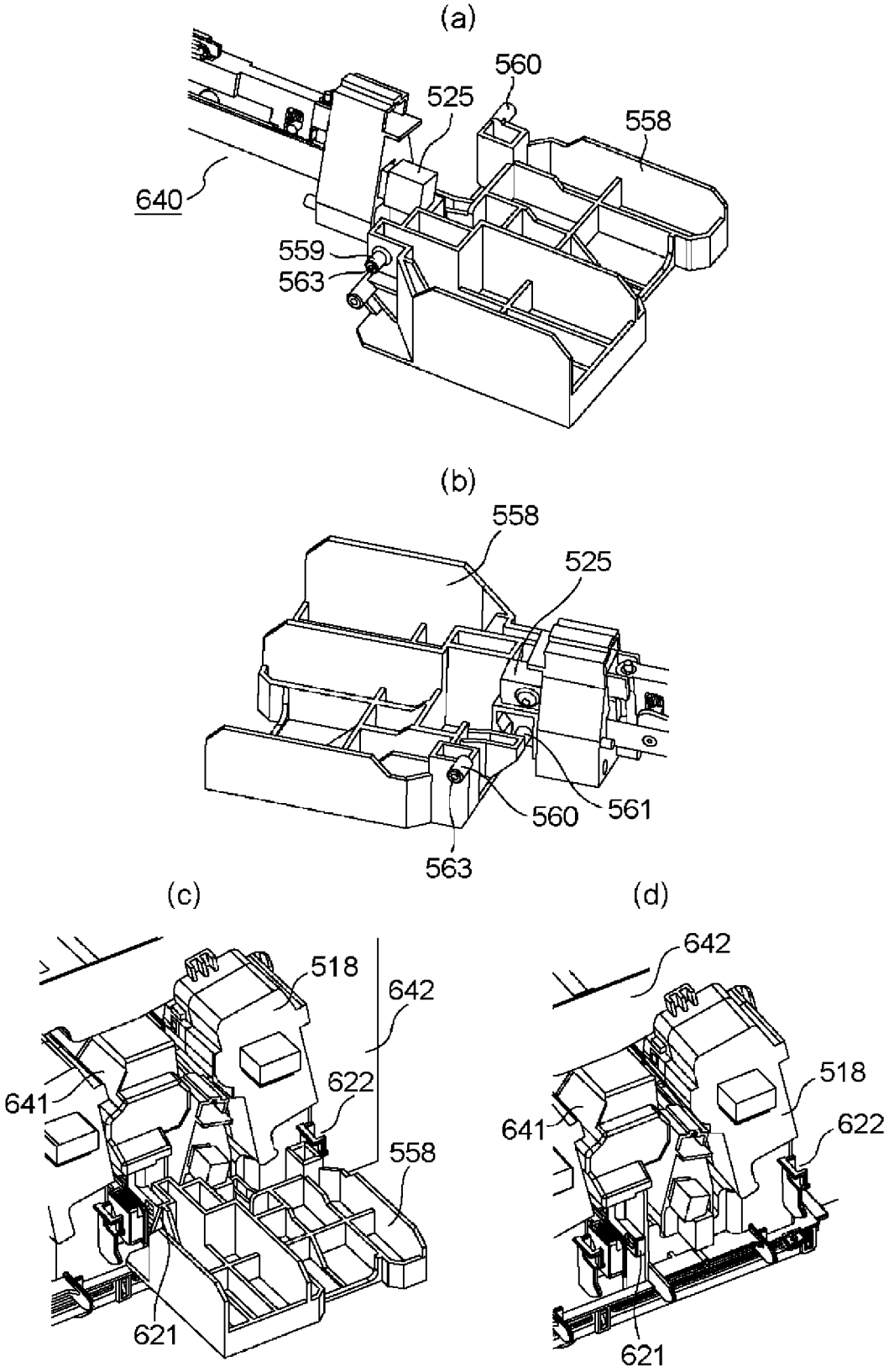

Parts (a) to (d) of FIG. 11 are perspective views of a cover.

Figure 12:
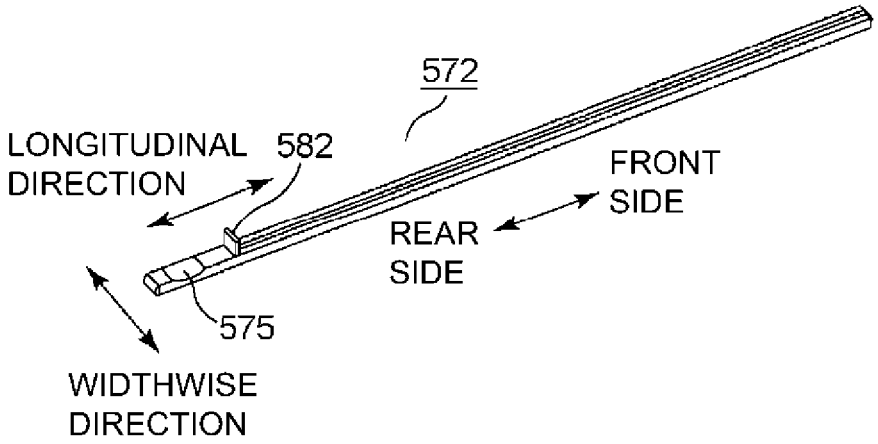

FIG. 12 is a schematic perspective view of a cleaning member.

Figure 13:
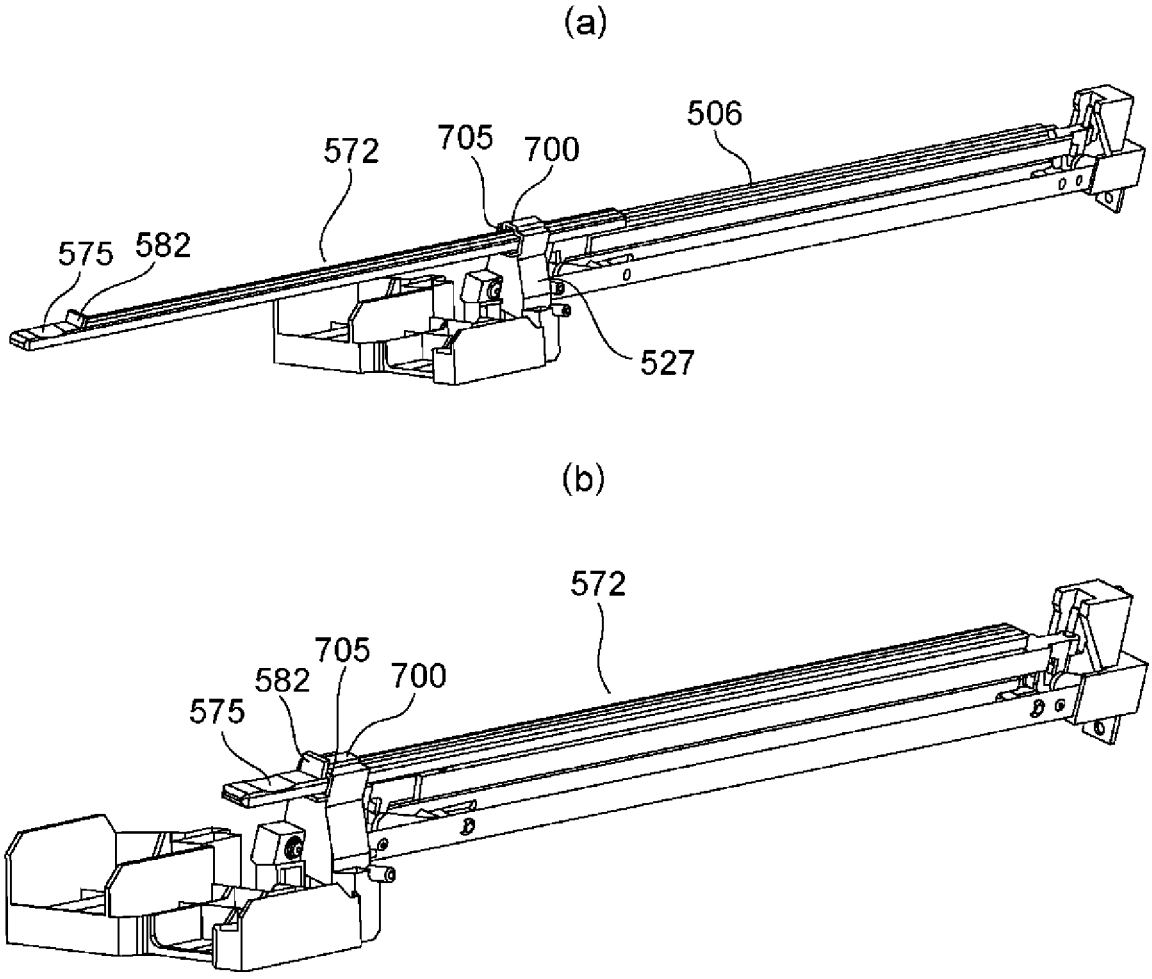

Parts (a) and (b) of FIG. 13 are schematic views for illustrating a state in which a contact portion of the cleaning member contacts a portion-to-be-contacted at an opening.

Figure 14:
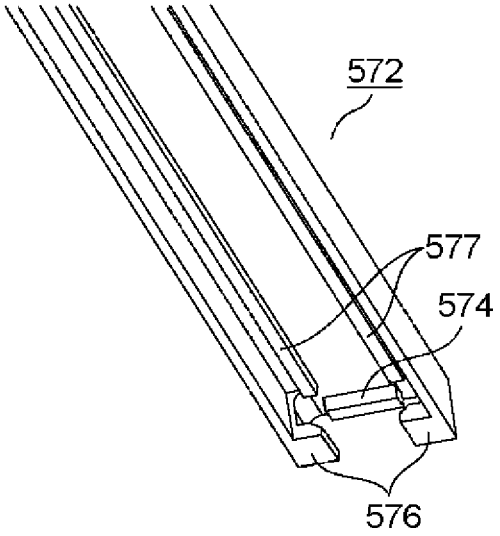
Figure 14:
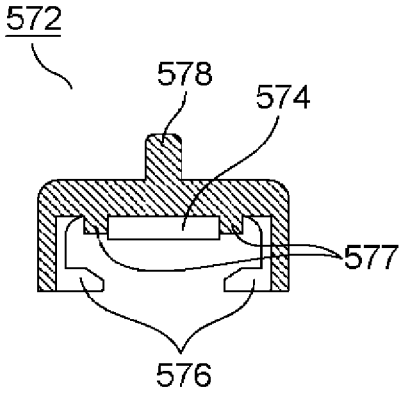

Parts (a) and (b) of FIG. 14 are schematic views for illustrating a structure of the cleaning member.

Figure 15:
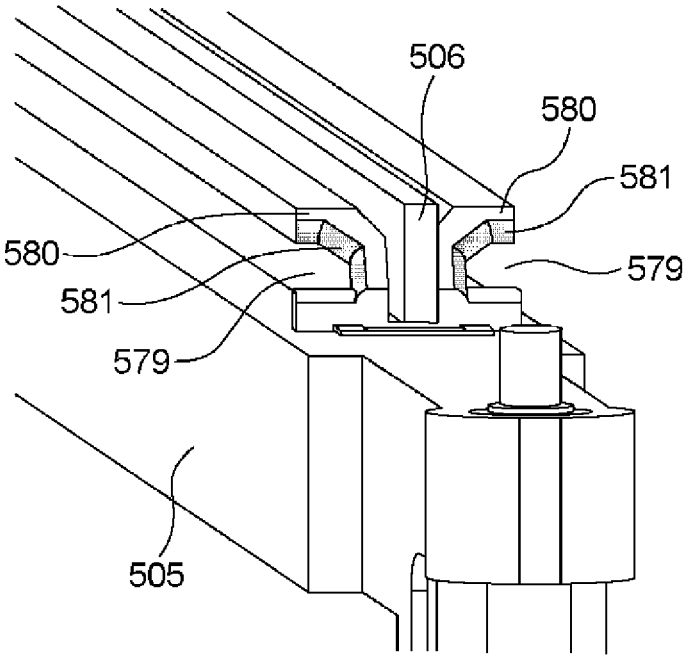

FIG. 15 is a schematic view for illustrating one end side of a lens mounting portion formed on a holding member.

Figure 16:
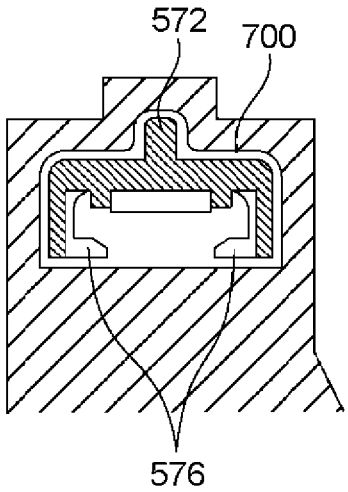
Figure 16:
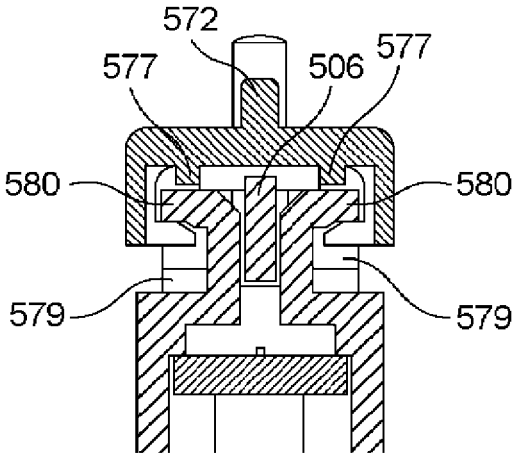

Parts (a) and (b) of FIG. 16 are schematic views for illustrating a state in which movement of the cleaning member is prevented by the opening and the holding member.

Figure 17:
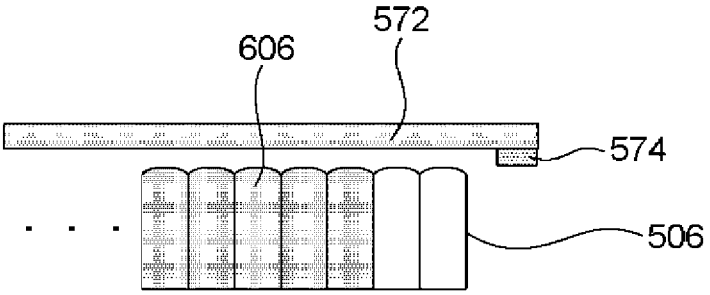
Figure 17:
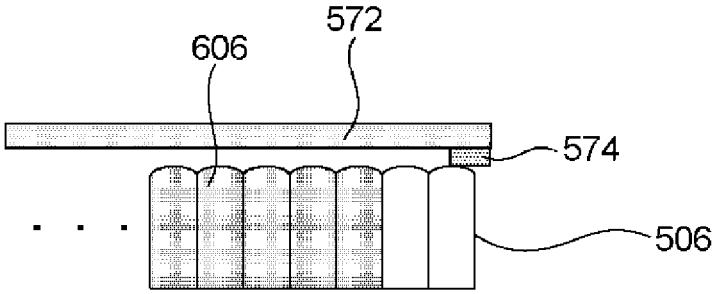

Parts (a) and (b) of FIG. 17 are schematic views for illustrating a positional relationship between a slidable portion and a lens array.

DESCRIPTION OF EMBODIMENTS

In the following, embodiments for carrying out the present invention will be described using the attached drawings. However, constituent elements described in the following embodiments are merely examples, and the present invention is not limited to those in the following embodiments.

(Image Forming Apparatus)

Figure 1:
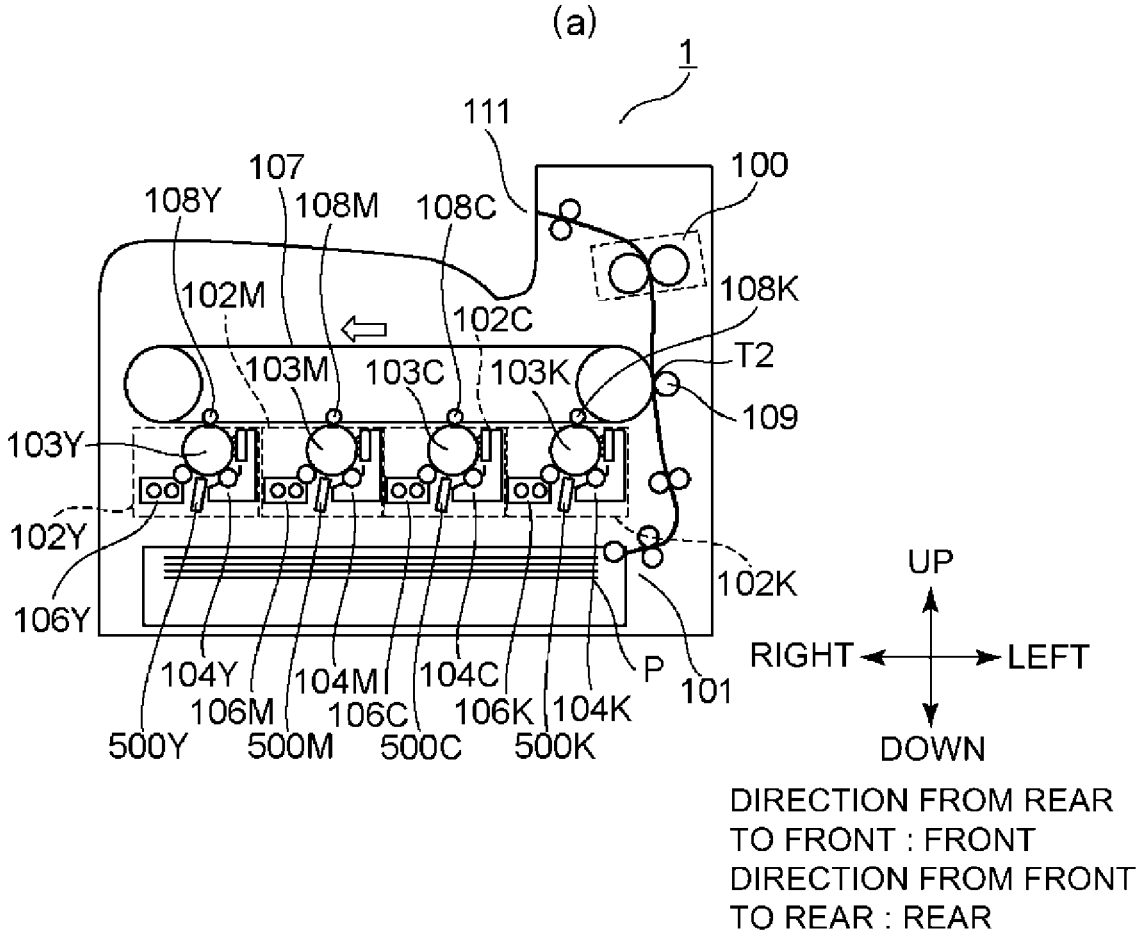
Figure 1:
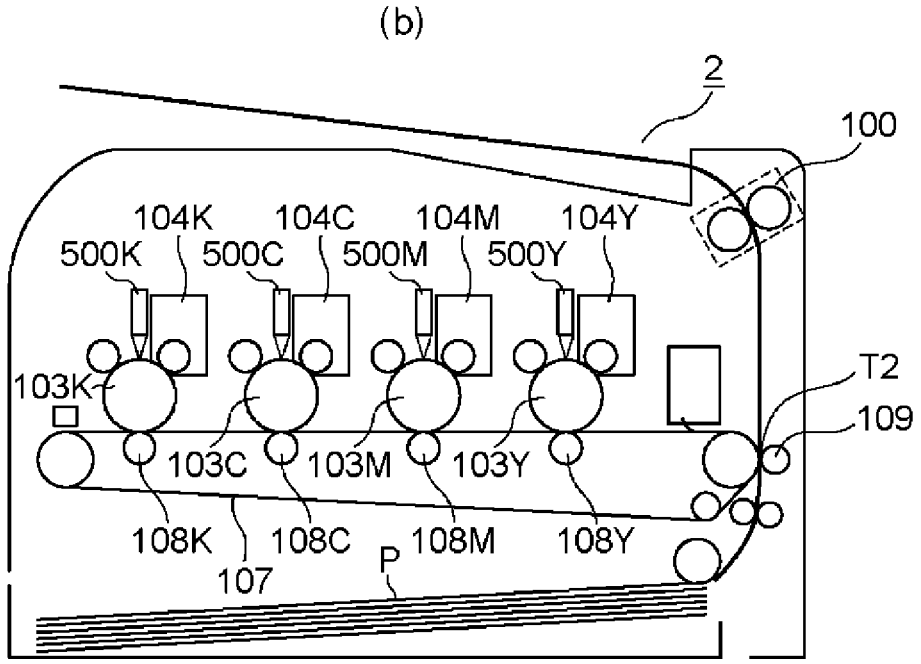

First, a schematic structure of an image forming apparatus 1 will be described. Part (a) of FIG. 1 is a schematic sectional view of the image forming apparatus 1. The image forming apparatus 1 shown in part (a) of FIG. 1 is a color printer (SFP: single function printer) including no reading device but may also be a copying machine including a reading device. Further, the image forming apparatus in this embodiment is not limited to a color image forming apparatus including a plurality of photosensitive drums 103 as shown in part (a) of FIG. 1 but may also be a color image forming apparatus including a single photosensitive drum 103 or an image forming apparatus for forming a monochromatic image.

The image forming apparatus 1 shown in part (a) of FIG. 1 includes four image forming portions 102Y, 102M, 102C and 102K (hereinafter collectively referred simply to as also an "image forming portion 102") for forming toner images of yellow, magenta, cyan and black, respectively. The image forming portions 102Y, 102M, 102C and 102K include photosensitive drums 103Y, 103M, 103C and 103K ("photosensitive drum 103"), and charging devices 104Y, 104M, 104C and 104K ("charging device 104") for electrically charging the photosensitive drums 103Y, 103M, 103C and 103K, respectively. The image forming portions further include LED (light emitting diode) exposure units 500Y, 500M, 500C and 500K ("exposure unit 500") as light sources for emitting light (beams) to which the photosensitive drums 103Y, 103M, 103C and 103K are exposed, respectively, and developing devices 106Y, 106M, 106C and 106K ("developing device 106") each for developing an electrostatic latent image on the photosensitive drum 103 with toner into a toner image of an associated color on the photosensitive drum 103. Incidentally, suffixes Y, M, C and K of the respective constituent elements represent colors of the toners.

The image forming apparatus 1 shown in part (a) of FIG. 1 is an image forming apparatus employing a so-called "lower surface exposure type" in which the photosensitive drum 103 is exposed to light from below. In the following, description will be made on the precondition that the image forming apparatus employing the lower surface exposure type is used, but in this embodiment, an image forming apparatus employing an "upper surface exposure type" in which the photosensitive drum 3 is exposed to light from above, such as an image forming apparatus 2 shown in part (b) of FIG. 1 may also be used.

The image forming apparatus 1 includes an intermediary transfer belt 107 onto which the toner images formed on the photosensitive drums 3 are to be transferred and primary transfer rollers 108 (Y, M, C, K) for successively transferring the toner images from the photosensitive drums 103 onto the intermediary transfer belt 107. The image forming apparatus 1 further includes a secondary transfer roller 109 for transferring the toner images from the intermediary transfer belt 107 onto recording paper P fed from a paper feeding portion 101 and includes a fixing device 100 for fixing the secondary-transferred toner images on the recording paper P.

(Image Forming Process)

The exposure unit 500 exposes to light the surface of the photosensitive drum 103Y charged by the charging device 104Y. As a result, the electrostatic latent image is formed on the photosensitive drum 103Y. Then, the developing device 106Y develops the electrostatic latent image, formed on the photosensitive drum 103Y, with yellow toner. A resultant yellow toner image formed on the photosensitive drum 103Y through development of the electrostatic latent image is transferred onto the intermediary transfer belt 107 by the primary transfer roller 108Y. The toner images of magenta, cyan and black are also transferred onto the intermediary transfer belt 107 by a similar image forming process.

The respective color toner images transferred on the intermediary transfer belt 107 are fed to a secondary transfer portion T2 by the intermediary transfer belt 107. To the secondary transfer roller 109 disposed at the secondary transfer portion T2, a transfer bias for transferring the toner images onto the recording paper P has been applied. The toner images fed to the secondary transfer portion T2 are transferred, onto the recording paper P fed from the paper feeding portion 101, under application of the transfer bias to the secondary transfer roller 109. The recording paper P on which the toner images are transferred is fed to the fixing device 100. The fixing device 100 fixes the toner images on the recording paper P by heat and pressure. The recording paper P subjected to a fixing process by the fixing device 100 is discharged onto a paper discharge portion 111.

(Drum Unit and Developing Unit)

In the image forming apparatus 1 of this embodiment, a drum unit 518 which is an example of an exchangeable drum cartridge is mounted. The drum unit 518 is a cartridge to be exchanged by an operator such as a user or a maintenance person. The drum unit 518 (Y, M, C, K) in this embodiment includes the photosensitive drum 103 (Y, M, C, K) rotatably supported by a frame thereof. However, the drum unit 518 may also have a constitution in which the charging unit 104 and a cleaning device are not provided.

Further, in the image forming apparatus 1 of this embodiment, a developing unit 641 which is a separate member from the drum unit 518 is mounted. The developing unit 641 is a cartridge prepared by integrally assembling the developing device 106 shown in part (a) of FIG. 1 and a toner accommodating portion into a unit. The developing unit 641 includes a developing sleeve which is a developer carrying member for carrying a developer (toner and a carrier). The developing unit 641 is provided with a plurality of gears for rotating a screw for stirring the toner and the carrier. When these gears are aging-deteriorated or the like, the operator dismounts the developing unit 641 from the apparatus main assembly of the image forming apparatus 1 and exchanges the developing unit 641 with new one. Incidentally, the forms of the drum unit 518 and the developing unit 641 may also be a process cartridge prepared by integrally assembling the drum unit 518 and the developing unit 641 into a unit.

Figure 2:
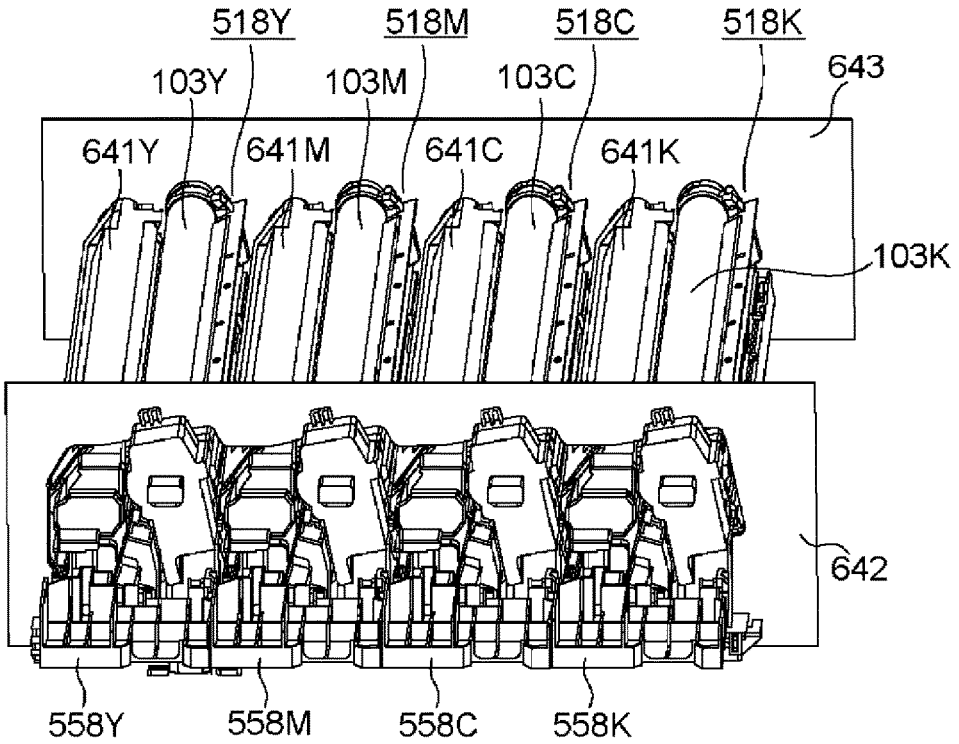
Figure 2:
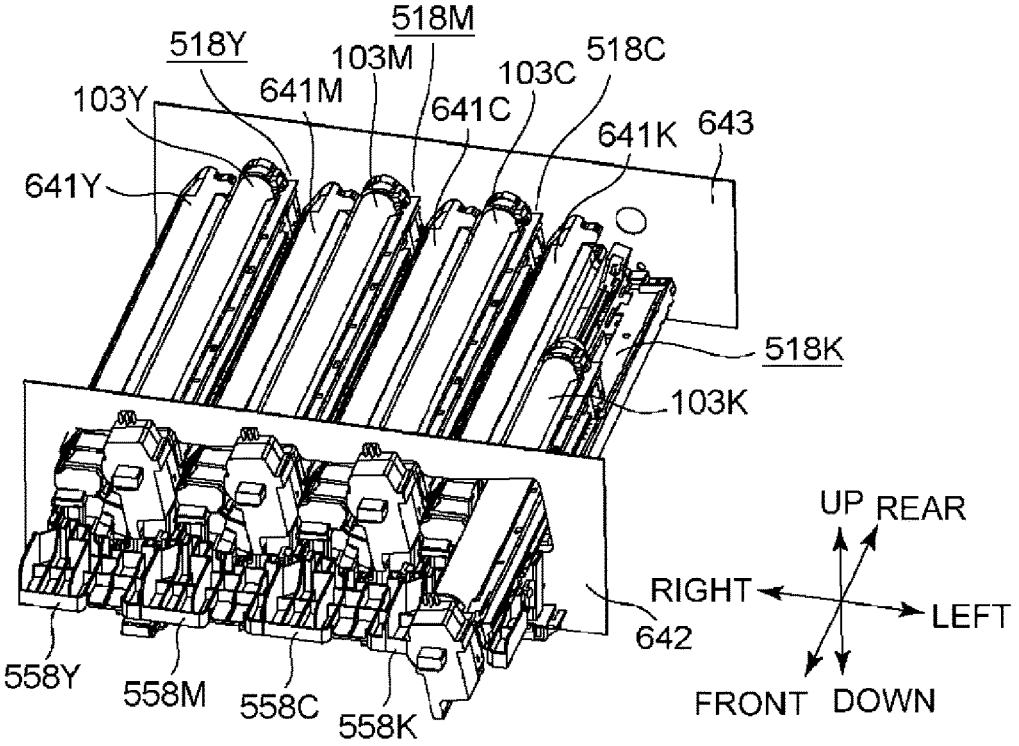

Part (a) of FIG. 2 is a perspective view showing a schematic structure of the drum unit 518, the developing unit 641 and peripheral portions thereof. Part (b) of FIG. 2 is a perspective view showing a state in which the drum unit 518 is being inserted from an outside of the apparatus main assembly into the image forming apparatus 1.

As shown in part (a) of FIG. 2, the image forming apparatus 1 includes a front side plate 642 formed with a metal plate constituting a part of a casing of the apparatus main assembly and a rear side plate 643 formed with a metal plate constituting a part of the casing of the apparatus main assembly. The front side plate 642 is a side wall provided on a front side of the image forming apparatus 1. The rear side plate 643 is a side wall provided on a rear side of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame (apparatus main assembly) of the image forming apparatus 1.

The front side plate 642 is provided with an opening through which the drum unit 518 and the developing unit 641 can be inserted from the front side into and extracted from the image forming apparatus 1. The drum unit 518 and the developing unit 641 are mounted at a predetermined position of the main assembly of the image forming apparatus 1 through the opening (mounting position). Further, the image forming apparatus 1 includes a cover 558 (Y, M, C, K) for covering a front side of both of the drum unit 518 and the developing unit 641 which are mounted in the mounting position. The cover 558 is fixed at one end thereof to the main assembly of the image forming apparatus 1 by a hinge, whereby the cover 558 is rotatable relative to the main assembly of the image forming apparatus 1. The operator for performing maintenance opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation is completed. The cover 558 will be further specifically described later.

Here, as shown in parts (a) and (b) of FIG. 2, in the following description, the front side plate 642 side and the rear side plate 643 side are defined as a front side and a rear side, respectively. Further, when a position of the photosensitive drum 103K on which the electrostatic latent image relating to the black toner image is formed is taken as a reference position, a side where the photosensitive drum 103Y on which the electrostatic latent image relating to the yellow toner image is formed is disposed is defined as a right side. Further, when a position of the photosensitive drum 103Y is taken as a reference position, a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, with respect to a rotational axis direction of the photosensitive drum 3, one end side means the front side and the other end side means the rear side. Further, one end side and the other end side with respect to the front-rear direction also correspond to the front side and the rear side, respectively. Further, with respect to the left-right direction, one end side means the right side and the other end side means the left side.

(Exposure unit)

Next, the exposure unit 500 including an optical print head 105 will be described. Here, as an example of an exposure type employed in an image forming apparatus of an electrophotographic type, there is a laser beam scanning exposure type in which a beam emitted from a semiconductor laser is deflected for scanning by a rotating polygon mirror and the photosensitive drum 1 is exposed to the beam through an f-θ lens or the like. The "optical print head 105" described in this embodiment is used in an LED exposure type in which the photosensitive drum 103 is exposed to light by using light emitting elements such as LEDs or the like arranged along the rotational axis direction of the photosensitive drum 103 and thus is not used in the laser beam scanning exposure type described above.

Figure 3:
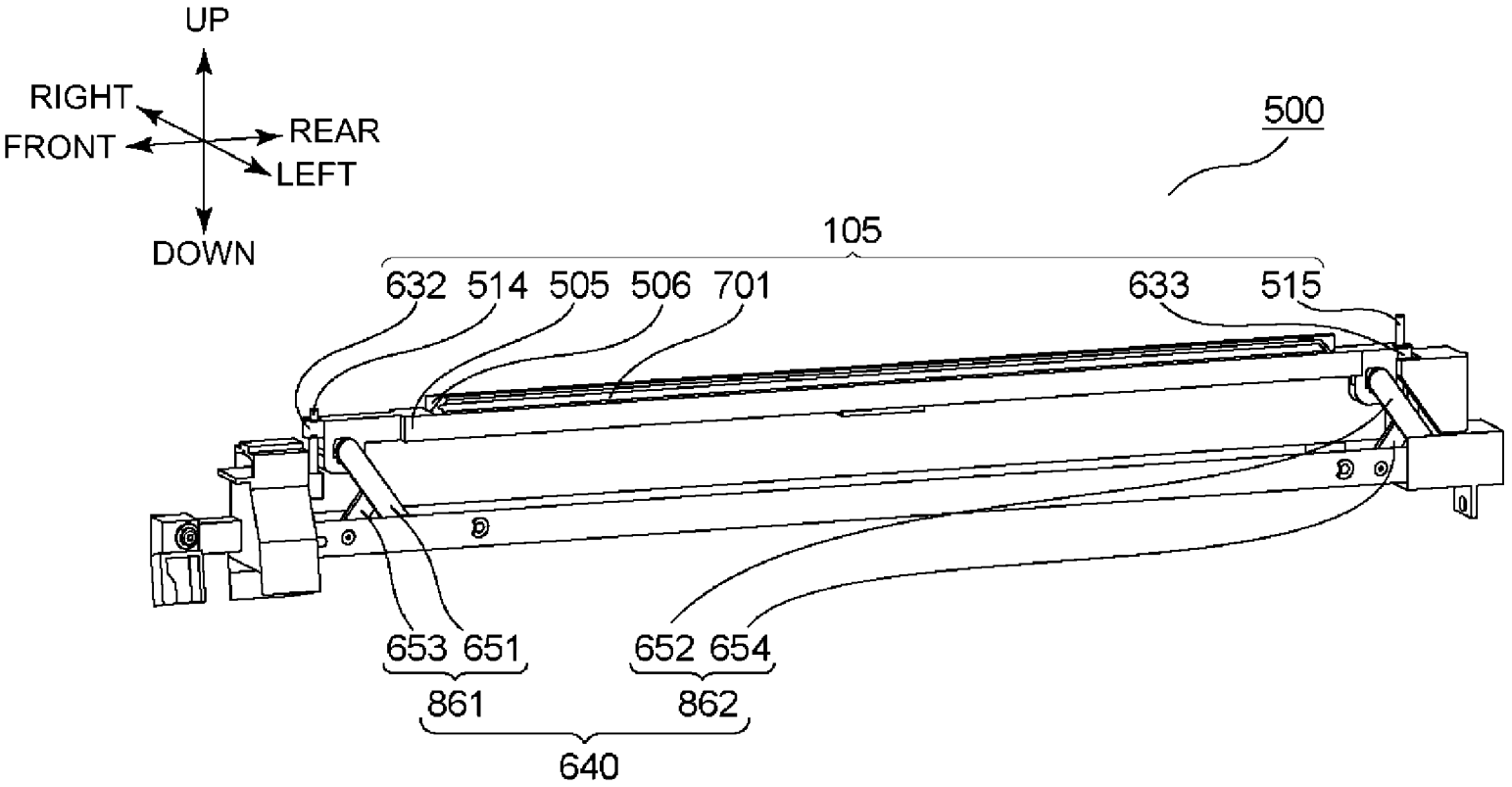
FIG. 3 is a schematic perspective view of an exposure unit.

The exposure unit 500 described in this embodiment is provided on a side below a rotational axis of the photosensitive drum 103 with respect to the vertical direction, and the photosensitive drum 103 is exposed to light from below by LEDs 503 of the optical print head 105. However, a constitution in which the exposure unit 500 is provided on a side above the rotational axis of the photosensitive drum 103 with respect to the vertical direction and in which the photosensitive drum 103 is exposed to light from above by the LEDs 503 of the optical print head 105 may also be employed (part (b) of FIG. 1). FIG. 3 is a schematic perspective view of the exposure unit 500 provided in the image forming apparatus 1 of this embodiment.

Referring to FIG. 3, the exposure unit 500 includes the optical print head 105 and a moving mechanism 640. The optical print head 105 includes a lens array 506, a lens mounting portion 701, a holding member 505 for holding a substrate 502 (not shown in FIG. 3), a first contact member 514 (an example of a projection), a second contact member 515 (an example of a projection) and pin mounting portions 632 and 633 on which the first contact member 514 and the second contact member 515 are mounted, respectively.

The first contact member 514 and the second contact member 515 contact the drum unit 518, so that a gap (interval) is formed between the lens array 506 and the photosensitive drum 103, and thus a position of the optical print head 105 during image formation is determined. The moving mechanism 640 includes a first link mechanism 861, a second link mechanism 862 and a slidable portion 525. The first link mechanism 861 includes a link member 651 and a link member 653. The second link mechanism 862 includes a link member 652 and a link member 654. With an opening and closing operation of the unshown cover 558, the slidable portion 525 slides in the front-rear direction. In interrelation with the slide (movement) of the slidable portion 525, the first link mechanism 861 and the second link mechanism 862 are driven, so that the optical print head 105 is moved upward and downward. Of the frame of the drum unit 518, portions on which the contact members (514, 515) abut, for example, engaging holes in which free end portions of these contact members (514, 515) engage by about 5 mm are provided. As a result, the optical print head 105 is accurately positioned to the photosensitive drum 3. A specific operation mechanism of the moving mechanism will be described later.

In this embodiment, the first contact member 514 and the second contact member 515 are described as cylindrical pins. However, the shape of the pins is not limited to a cylindrical shape but may also be a prism shape. Further, the shape of the pins may also be a conical shape such that a diameter decreases toward a point. Further, the first and second contact members 514 and 515 are not limited to the pins but may also be projections integrally molded with the holding member 505.

For explaining a structure of the optical print head 105, first, the holding member 505 will be described. The holding member 505 is a holder for holding the substrate 502, the lens array 506 and the first and second contact members 514 and 515. A function of the first and second contact members 514 and 515 will be described specifically later. Incidentally, the holding member 505 in this embodiment is made of a resin material but may also be made of metal. In the following, projection lengths of the first and second contact members 514 and 515 from the holding member 505 are summarized.

First contact member 514 projecting from upper surface of holding to member 505: 7 mm Second contact member 515 projecting from upper surface of holding member 505: 11 mm First contact member 514 projecting from lower surface of holding member 505: 22 mm Second contact member 515 projecting from lower surface of holding member 505: 22 mm Next, the substrate 502 held by the holding member 505 will be described. Part (a) of FIG. 4 is a schematic perspective view of the substrate 502. Part (b1) of FIG. 4 is a schematic view showing an arrangement of a plurality of LEDs 503 provided on the substrate 502. Part (c) of FIG. 4 is an enlarged view of part (b1) of FIG. 4.

On the substrate 502, LED chips 639 are mounted. As shown in part (a) of FIG. 4, on one surface of the substrate 502, the LED chips 639 are provided, and on the other surface of the substrate 502, a connector 504 is provided. On the substrate 502, electrical wiring for supplying signals to the respective LED chips 639 is provided. To the connector 504, one end of an unshown flexible flat cable (FFC) is connected. In the image forming apparatus 1 main assembly, a substrate including a controller and a connector is provided. The other end of the FFC is connected to the connector. To the substrate 502, a control signal is inputted from the controller of the image forming apparatus 1 main assembly through the FFC and the connector 504.

The LED chips 639 mounted on the substrate 502 will be described further specifically. As shown in parts (b1) and (b2) of FIG. 4, on one surface of the substrate 502, a plurality of LED chips 639-1 to 639-29 (29 LED chips) where a plurality of LEDs 503 (an example of the light emitting element) are disposed. On each of the LED chips 639-1 to 639-29, 516 LEDs 503 are arranged in a line along a longitudinal direction of the LED chips 639. With respect to the longitudinal direction of the LED chips 639, a center distance k2 between adjacent LEDs 503 corresponds to resolution of the image forming apparatus 1. The resolution of the image forming apparatus 1 is 1200 dpi, and therefore, in the longitudinal direction of the LED chips 639-1 to 639-29, the LEDs 503 arranged in a line so that the center distance of the LEDs 503 is 21.16 μm. For that reason, an exposure range of the optical print head 105 in this embodiment is about 314 mm. A photosensitive layer on the photosensitive drum 103 is formed with a width of 314 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two (parallel) lines along the rotational axis direction. That is, as shown in part (b1) of FIG. 4, odd-numbered LED chips 639-1, 639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 4, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs 503 on one (e.g., 639-1) of LED chips 503. Incidentally, in this embodiment, a constitution using the LEDs 503 as an exposure light source is described as an example, but as the exposure light source, an organic EL (electro luminescence) device may also be used.

Next, a lens array 506 will be described. Part (c1) of FIG. 4 is a schematic view of the lens array 506 as seen from the photosensitive drum 103 side. Further, part (c2) of FIG. 4 is a schematic perspective view of the lens array 506. As shown in part (c1) of FIG. 4, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent lenses arranged in the arrangement direction of the lenses arranged in the above-described one line. Each of the lenses is a cylindrical rod lens made of glass. Incidentally, a material of the lens is not limited to glass but may also be plastics. Also shapes of the lenses are not limited to the cylindrical shape but may also be a polygonal prism shape such as a hexagonal prism shape.

A broken line Z shown in part (c2) of FIG. 4 represents an optical axis of the lens. The optical print head 105 is movable by the moving mechanism 640 in a direction (up-down direction) roughly along the optical axis of the lens indicated by the broken line Z. The optical axis of the lens referred to herein means a line connecting a center of a light emergent surface of the lens and a focus of the lens. Emitted light emitted from the LED 503 enters the lens of the lens array 506. The lens has a function of focusing the emitted light entering the lens on the surface of the photosensitive drum 103. A mounting position of the lens array 506 relative to the lens mounting portion 701 (FIG. 3) is adjusted during assembling of the optical print head 105 so that a distance between a light emergent surface of the LED 503 and a light incident surface of the lens and a distance between a light emergent surface of the lens and the surface of the photosensitive drum are substantially equal to each other.

(Moving Mechanism)

Next, necessity to move the optical print head 105 in the up-down direction and a structure of the optical print head 105 will be specifically described. FIG. 5 is a schematic view of the exposure unit 500 as seen from a right side. As described above, as regards the image forming apparatus 1 of this embodiment, the drum unit 518 can be exchanged. The exchange of the photosensitive drum 103 is carried out by dismounting the drum unit 518, to be exchanged, from the apparatus main assembly by moving the drum unit 518 toward a front side of the photosensitive drum 103 with respect to the rotational axis direction of the photosensitive drum 103. When the drum unit 518 is moved in a state in which the optical print head 105 is positioned in the neighborhood of the surface of the photosensitive drum 103, for example, the surface of the photosensitive drum 103 and the lens array 506 are in contact with each other, so that there is a liability that the surface of the photosensitive drum 103 is damaged. Further, there is also a liability that the lens array 506 contacts the frame or the like of the drum unit 518 and thus is damaged. For that reason, during the exchange of the drum unit 518, there is a need that the optical print head 105 is spaced from the drum unit 518 so that the drum unit 518 and the optical print head 105 are not in contact with each other. On the other hand, during image formation, there is a need that the optical print head 105 is positioned to the photosensitive drum 103 with accuracy. For that reason, there is a need to provide a mechanism (moving mechanism 640) for reciprocating the optical print head 105 between a position where the optical print head 105 is positioned to the photosensitive drum 103 for exposing the photosensitive drum 103 to light with the LEDs 503 (this position is referred to as an exposure position: part (a) of FIG. 5) and a position where positioning of the optical print head 105 is eliminated for exchanging the drum unit 518 (this position is referred to as an exchanging position: part (b) of FIG. 5). When the slidable portion 525 is moved in an arrow A direction in a state in which the optical print head 105 is in the exposure position (part (a) of FIG. 5), the optical print head 105 is moved toward the exchanging position (part (b) of FIG. 5). On the other hand, when the slidable portion 525 is moved in an arrow B direction in a state in which the optical print head 105 is in the exchanging position (part (b) of FIG. 5), the optical print head 105 is moved toward the exposure position (part (a) of FIG. 5).

In the following, a structure of the moving mechanism 640 will be described specifically. Part (a) of FIG. 6 is a schematic perspective view of the moving mechanism 640 when a front side of the moving mechanism 640 is seen from a left side, and part (b) of FIG. 6 is a schematic perspective view of the moving mechanism 640 when a rear side of the moving mechanism 640 is seen from a right side. The moving mechanism 640 includes the first link mechanism 861, the slidable portion 525 and a third supporting portion 526. The third supporting portion 526 includes a supporting shaft 531 and an E-shaped stopper ring 533. The supporting shaft 531 is inserted through openings provided in surfaces (left side surface and right side surface) which opposes with respect to the left-right direction of the third supporting portion 526. Further, the supporting shaft 531 is retained by the E-shaped stopper ring 533 on an outside of the left side surface so as not to be disconnected through the opening of the third supporting portion 526. As a result, the supporting shaft 531 is fixed in a state in which the supporting shaft 531 connects the left side surface and the right side surface of the third supporting portion 526.

The slidable portion 525 is provided with an elongated hole 691 extending in the front-rear direction. The supporting shaft 531 is inserted into the elongated hole 691 and is loosely engaged in the elongated hole 691 with a to gap of, e.g., about 0.1-0.5 mm with respect to the up-down direction. For that reason, the slidable portion 525 is slidable (movable) relative to the third supporting portion 526 in a distance corresponding to a length of the elongated hole 691 with respect to the front-rear direction in a state in which movement of the slidable portion 525 relative to the third supporting portion 526 with respect to the up-down direction is prevented.

The first link mechanism 861 includes the link member 651 and the link member 653. A length of the link member 653 with respect to the longitudinal direction is shorter than a length of the link member 651 with respect to the longitudinal direction, and the link members 651 and 653 constitute a link member of λ type.

The first link mechanism 861 will be described using FIGS. 6 and 7. Part (a) of FIG. 7 is a schematic view of a cross-section of the first link mechanism 861 cut along the rotational axis direction in the left-right direction as seen from the right side. Each of the link members 651 and 653 is a single link member, but may also be constituted by combining a plurality of link members.

The link member 651 includes a bearing portion 610, a projection 655 and a connecting shaft portion 538. The bearing portion 610 is a cylindrical project provided with a hollow hole and stands toward the right side on one end side of the link member 651 with respect to the longitudinal direction. The projection 655 is a cylindrical projection standing in the rotational axis direction of the link member 651 on the other end side of the link member 651 with respect to the longitudinal direction. This projection is mounted to the holding member 505 of the optical print head 105. The connecting shaft portion 538 is provided between the bearing portion 610 and the projection 655 with respect to the longitudinal direction of the link member 651.

The slidable portion 525 is provided with an engaging shaft portion 534. The engaging shaft portion 534 is a cylindrical projection standing from the slidable portion 525 in the left direction. The engaging shaft portion 534 forms a first connecting portion by being engaged rotatably in a hole of the bearing portion 610. That is, the link member 651 is rotatable about the first connecting portion relative to the slidable portion 525. Incidentally, in this embodiment, a constitution in which the engaging shaft portion 534 is formed on the link member 651 side and in which the bearing portion 610 is formed on the slidable portion 525 side may also be employed.

The link member 653 includes a connecting shaft portion 530. The connecting shaft portion 530 is provided on one end side of the link member 653 with respect to the longitudinal direction of the link member 653. The connecting shaft portion 530 is a cylindrical project standing from the link member 653 toward the left side. The connecting shaft portion 530 is engaged rotatably in a hole formed in the third supporting portion 526 and forms a second connecting portion. In this embodiment, the connecting shaft portion 530 may also be formed on the third supporting portion 526, not the link member 653. That is, in the hole provided in the link member 653, the connecting shaft portion 530 formed on the third supporting portion 526 may also be engaged.

The link member 653 is provided with a circular hole formed on the other end side thereof with respect to the longitudinal direction. In the hole, the connecting shaft portion 538 of the link member 651 is rotatably engaged, so that the connecting shaft portion 538 and the hole of the link member 653 form a fourth connecting portion. That is, the link member 653 is rotatable about the third connecting portion relative to the third supporting portion 526 and is rotatable about the fourth connecting portion relative to the link member 651. In this embodiment, the connecting shaft portion 538 may also be formed on the link member 653, not the link member 651. That is, the connecting shaft portion 538 to formed on the link member 653 may also be rotatably engaged in a hole formed in the link member 651.

A structure of the second link mechanism 862 is also similar to the above-described structure of the first link mechanism 861. The link members 652 and 654 of the second link mechanism 862 correspond to the link members 651 and 653, respectively, of the first link mechanism 861. Correspondingly to the first connecting portion, connecting portion between one end side portion of the link member 652 with respect to the longitudinal direction and the slidable portion 525 constitutes a second connecting portion. Incidentally, in the moving mechanism 640, either one of the link members 653 and 654 may also be omitted.

By the above constitution, when the slidable portion 525 is slid from the front side toward the rear side relative to the third supporting portion 526, the bearing portion 610 engaged with the engaging shaft portion 534 is slid together with the slidable portion 525 from the front side toward the rear side relative to the third supporting portion 526. As a result, when the first link mechanism 861 is seen from the rear side, the first link mechanism 861 is rotated about the engaging shaft portion 534 in the clockwise direction, and the link member 653 is rotated about the connecting shaft portion 530 in the counterclockwise direction. Therefore, the projection 655 is moved from the exposure position toward a retracted position.

On the other hand, when the slidable portion 525 is slid (moved) from the rear side toward the front side relative to the third supporting portion 526, the link members 651 and 653 are moved in a direction opposite to the arrow direction shown in part (a) of FIG. 7. When the slidable portion 525 is slid from the rear side toward the front side relative to the third supporting portion 526, the bearing portion 610 engaged with the engaging shaft portion 534 is slid together with the slidable portion 525 from the rear side toward the front side to relative to the third supporting portion 526. As a result, as shown in part (a) of FIG. 7, when the first link mechanism 861 is seen from the rear side, the first link mechanism 861 is rotated about the engaging shaft portion 534 in the counterclockwise direction, and the link member 653 is rotated about the connecting shaft portion 530 in the clockwise direction. Therefore, the projection 655 is moved from the retracted position toward the exposure position.

Here, (1) a distance between a rotation center axis of the connecting shaft portion 538 and a rotation center axis of the bearing portion 610 is L1, (2) a distance between the rotation center axis of the connecting shaft portion 538 and a rotation center axis of the connecting shaft portion 530 is L2, and (3) a distance between the rotation center axis of the connecting shaft portion 538 and a rotation center axis of the projection 655 is L3. In the moving mechanism 640, the first link member 641 forms Scott-Russel's mechanism in which L1, L2 and L3 are equal to each other (part (b) of FIG. 7), so that the projection 655 is vertically moved (along a broken line A in part (b) of FIG. 7) with respect to a slide (movement) direction of the engaging shaft portion 534, and therefore, in the above-described link mechanism, the optical print head 105 can be moved substantially in an optical axis direction of the lens.

Incidentally, in this embodiment, a structure in which a combination of the link member 651 (652) and the link member 653 (654) in the first link mechanism 861 (second link mechanism 862) is reversed with respect to the front-rear direction, i.e., a structure in which a full length of the link member 651 (652) is shorter than a full length of the link member 653 (654) and in which the link member 651 (652) is mounted between one end side and the other end side of the link member 653 (654) may also be used. In this case, when the slidable portion 525 is slid from the front side toward the rear side, the optical print head 105 is moved from the retracted position toward the exposure position, and when to the slidable portion 525 is slid from the rear side toward the front side, the optical print head 105 is moved from the exposure position toward the retracted position. The cover 558 described later is connected with the slidable portion 525 and has a structure such that the slidable portion 525 is moved from the front side toward the rear side in interrelation with movement of the cover 558 from an open state toward a closed state and is moved from the rear side toward the front side in interrelation with movement of the cover 558 from the closed state toward the open state.

Further, the mechanism for moving the optical print head 105 is not limited to the moving mechanism 640 but may also be a moving mechanism 940 shown in FIG. 8. In the following, the moving mechanism 940 will be described using FIG. 8. Incidentally, members having functions substantially similar to the members constituting the moving mechanism 640 are described by adding thereto the same reference numerals or symbols and will be omitted from redundant description in some cases.

As shown in FIG. 8, a first cam portion 112 and a second cam portion 113 are provided on the front side and the rear side, respectively, of the slidable portion 525. Further, at a lower portion of a holding member 905 on the front side, a movement supporting portion 114 is provided, and at a lower portion of the holding member 905 on the rear side, a movement supporting portion 115 is provided. Each of the first and second cam portions 112 and 113 has an inclined surface descending from the rear side toward the front side.

Part (a) of FIG. 8 is a schematic view of the optical print head 105 located in the exposure position and the moving mechanism 940 as seen from the rear side. In the case where the optical print head 105 is in the exposure position, when the slidable portion 525 is slid from the front side toward the rear side relative to the third supporting portion 526, the first and second cam portions 112 and 113 are moved together with the slidable portion 525 from the front side toward the rear side relative to the third supporting portion 526. As a result, lower ends of the movement supporting members 114 and 115 provided on the holding member 905 are moved from the exposure position toward the retracted position along the first and second cam portions 112 and 113, respectively.

Part (b) of FIG. 8 is a schematic view of the optical print head 105 located in the retracted position and the moving mechanism 940 as seen from the rear side. In the case where the optical print head 105 is in the retracted position, when the slidable portion 525 is slid from the rear side toward the front side relative to the third supporting portion 526, the first and second cam portions 112 and 113 are moved together with the slidable portion 525 from the rear side toward the front side relative to the third supporting portion 526. As a result, lower ends of the movement supporting members 114 and 115 provided on the holding member 905 are moved from the retracted position toward the exposure position by being pushed upward by the first and second cam portions 112 and 113, respectively.

Here, the inclined surface of each of the first and second cam portions 112 and 113 may also descend from the front side toward the rear side. In this case, when the slidable portion 525 is slid from the front side toward the rear side, the optical print head 105 is moved from the retracted position toward the exposure position, and when the slidable portion 525 is slid from the rear side toward the front side, the optical print head 105 is moved from the exposure position toward the extracted position. The cover 558 described later has a structure such that the cover 558 is connected with the slidable portion 525 through a link mechanism, for example and the slidable portion 525 is moved from the front side toward the rear side in interrelation with movement of the cover 558 from the open state toward the closed state and is moved from the rear side toward the front side in interrelation with movement of the cover 558 from the closed state to the open state.

Incidentally, in this embodiment, the mechanism in which in response to the slide (movement) of the slidable portion 525, the optical print head 105 is moved between the exposure position and the exchanging position spaced from the photosensitive drum 103 than the exposure position is was described, but is not limited thereto. For example, an elastic member such as a spring for connecting the third supporting portion 526 and the holding member 505 so that the optical print head 105 is moved vertically relative to the third supporting portion 526 in response to mounting and dismounting of the drum unit 518 relative to the apparatus main assembly without providing the slidable portion 525, the link mechanisms (861, 862) and the cam mechanisms (112, 113) may also be provided. In the case of such a mechanism, when the drum unit 518 is mounted from the outside of apparatus main assembly, the optical print head 105 contacting the drum unit 518 is pushed down toward the third supporting portion 526 while urging the spring, so that the optical print head 105 is placed in the exposure position. In the case of such a constitution, a cleaning member 572 described later cleans the surface of the lens array 506 while sliding on the surface of the photosensitive drum 103.

Part (a) of FIG. 9 is a schematic perspective view of a first supporting portion 527 to which a front side portion of the third supporting portion 526 is to be mounted. The first supporting portion 527 includes a first bearing surface 586, a wall portion 127, a projection 601, a screw hole 602, positioning bosses 603 and 604, a screw hole 605 and a contact surface 681.

The first bearing surface 586 is a portion where a front side lower end of the holding member 505 moved from the exposure position toward the retracted position contacts the first bearing surface 586 from above with respect to the vertical direction. The holding member 505 contacts the first bearing surface 586, so that the optical print head 105 is placed in the retracted position.

The first supporting portion 527 is fixed to the front side plate 642. The front side plate 642 is provided with the positioning bosses 603 and 604 and a plurality of holes (not shown) corresponding to fixing bosses, respectively. The positioning bosses 603 and 604 and inserted in the holes provided in the front side plate 642. In that state, the first supporting portion 527 and the front side plate 642 are fixed with each other with screws passed through the screw holes 602 of the first supporting portion 527.

The wall portion 127 stands from the first supporting portion 527 toward the rear side so as to sandwich, with respect to the left-right direction, the first contact member 514 projecting from the lower side of the holding member 505. The wall portion 127 is provided at positions opposing left and rear side portions of the first contact member 514, so that member of the first contact member 514 in the left-right direction is prevented. As a result, the front side portion of the holding member 505 to which the first contact member 514 is fixed is also prevented from moving in the left-right direction.

Part (b) of FIG. 9 is a schematic view for illustrating a state in which the front side portion of the third supporting portion 526 is inserted into a portion enclosed by a broken line shown in part (a) of FIG. 9. Part (c) of FIG. 9 is a schematic view showing a state in which the front side portion of the third supporting portion 526 is inserted in the portion enclosed by the broken line shown in part (a) of FIG. 9. As shown in parts (b) and (c) of FIG. 9, the third supporting portion 526 is a metal plate bent in a channel shape. The third supporting portion 526 is provided with a cut-away portion on the front side thereof. The cut-away portion and the projection 601 of the first supporting portion 527 engage with each other, so that the position of the third supporting portion 526 relative to the first supporting portion 527 with respect to the left-right direction is determined. The third supporting portion 526 is fixed to the first supporting portion 527 by a screw inserted through the screw hole 602 in a state in which the third supporting portion 526 contacts the contact surface 681.

Part (a) of FIG. 10 is a schematic perspective view of a second supporting portion 528 to which a rear side portion of the third supporting portion 526 is to be mounted. The second supporting portion 528 includes a second bearing surface 587 and a wall portion 128.

The second bearing surface 587 has the same function as the above-described first bearing surface 586. To the second bearing surface 587, a rear side lower end of the holding member 505 moved from the exposure position toward the retracted position is contacted. That is, the holding member 505 of the optical print head 105 located in the retracted position is supported by the first bearing surface 586 and the second bearing surface 587.

The wall portion 128 stands from the second supporting portion 528 toward the front side so as to sandwich, with respect to the left-right direction, the second contact member 515 projecting from the lower side of the holding member 505. The wall portion 128 is provided at positions opposing left and rear side portions of the second contact member 515, so that member of the second contact member 515 in the left-right direction is prevented. As a result, the rear side portion of the holding member 505 to which the second contact member 515 is fixed is also prevented from moving in the left-right direction. The wall portion 127 described above prevents the movement of the first contact member 514 in the left-right direction, and the wall portion 128 prevents the movement of the second contact member 515 in the left-right direction, so that the holding member 505 is prevented from moving in the left-right direction over the longitudinal direction thereof. That is, it is possible to reduce a degree of a liability that the optical print head 105 moves in the left-right direction during movement from the retracted position toward the exposure position. In order to obtain this effect, the wall portions 127 and 128 may preferably be formed on the first supporting portion 527 and the second supporting portion 528, respectively, but the wall portion may also be formed on either one of the first and second supporting portions 527 and 528.

As shown in part (b) of FIG. 10, the second supporting portion 528 is fixed to the front side surface of the rear side plate 643. The second supporting portion 528 is fixed to the rear side plate 643 by a positioning boss and a screw. The exposure unit 500 in insert into an arrow direction shown in part (b) of FIG. 10 through an opening formed in the front side plate 642, so that the third supporting portion 526 is fixed to the second supporting portion 528.

Part (c) of FIG. 10 shows a state in which the rear side portion of the third supporting portion 528 is inserted in a portion enclosed by a broken line shown in part (a) of FIG. 10. The third supporting portion 526 is supported by the first supporting portion 527 on the front side and is supported by the second supporting portion 528 on the rear side. That is, both the first supporting portion 527 and the third supporting portion 528 are fixed to the image forming apparatus 1 main assembly. Therefore, the third supporting portion 526 is fixed to the image forming apparatus 1 main assembly and thus is not moved.

Incidentally, a constitution in which the second supporting portion 528 and the rear side plate 643 are not fastened with a screw may also be employed. In this case, for example, the second supporting portion 528 is provided with a recessed portion, and this recessed portion is engaged with a projected portion formed on the rear side plate 643, so that a structure in which a position of the second supporting portion 528 relative to the rear side plate 643 is determined is formed.

(Cartridge Cover)

Next, the cover 558 will be described using FIG. 11.

Part (a) of FIG. 11 is a perspective view of the cover 558 mounted to the moving mechanism 640 as seen from the right side, part (b) of FIG. 11 is a perspective view of the cover 558 mounted to the moving mechanism 640 as seen from the left side, part (c) of FIG. 11 is a perspective view for illustrating the front side plate 642 to which the cover 558 is mounted, and part (d) of FIG. 11 is a perspective view of the front side plate 642, in which the cover 558 is not shown. The operator such as a user or an operator can dismount the drum unit 518 from the apparatus main assembly by placing the cover 558 in an open state (part (c) of FIG. 11). The closed cover 558 positions on an insertion and extraction path of the drum unit 518 and the developing unit 641. For that reason, when the cover 558 is in a closed state, the operator cannot perform an exchanging operation of the drum unit 518 and the developing unit 641. The operator can exchange the drum unit 518 by opening the cover 558 and closes the cover 558 after an end of the operation.

As shown in parts (a) and (b) of FIG. 11, the cover 558 includes rotation shaft portions 559 and 560 and a pressing portion 561. The rotation shaft portion 559 is a circular column-shaped projection projecting toward the right side of the cover 558. On the other hand, the rotation shaft portion 560 is a circular column-shaped projection projecting toward the left side of the cover 558. Incidentally, a rotational axis 563 is a rotation center axis of the cover 558 rotatable about the rotation shaft portions 559 and 560.

As shown in part (b) of FIG. 11, the pressing portion 561 is positioned in a space provided on the front side of the slidable portion 525 in a state in which the cover 558 is mounted to the front side plate 642. When the cover 558 is rotated about the rotation axis 563, the pressing portion 561 moves the slidable portion 525 in the front-rear direction in interrelation with the rotation. Specifically, when the operator rotates the cover 558 from the closed state toward the open state, the pressing portion 561 moves the slidable portion 525 from the front side toward the rear side. In interrelation with this movement of the slidable portion 525 from the front side toward the rear side, the optical print head 105 moves from the exposure position toward the retracted position. That is, when the operator opens the cover 558, the optical print head 105 moves toward the retracted position, so that the gap between the photosensitive drum 103 and the optical print head 105 increases. As a result, the operator can perform the exchanging operation of the drum unit 518 without contacting the drum unit 518 to the optical print head 105. On the other hand, when the operator rotates the cover 558 from the open state toward the closed state, the pressing portion 561 moves the slidable portion 525 from the rear side toward the front side. In interrelation with this movement of the slidable portion 525 from the rear side toward the front side, the optical print head 105 moves from the retracted position toward the exposure position.

A constitution for sliding (moving) the slidable portion 525 is not limited to the cover 558. For example, a constitution in which the slidable portion 525 is slid in interrelation with opening and closing of an unshown front door may also be employed. Further, a constitution in which the slidable portion 525 is slid in interrelation with rotation of a rotatable member such as a lever, not a covering member such as the cover 558 or a door may also be employed.

As shown in parts (c) and (d) of FIG. 11, the front side plate 642 includes a bearing member 621 engageable with the rotation shaft portion 559 of the cover 558 and includes a bearing member 622 engageable with the rotation shaft portion 560 of the cover 558. Further, as shown in part (c) of FIG. 11, to the rotation shaft portion 559 of the cover 558 rotatably engages with the bearing member 621 of the front side plate 642, and the rotation shaft portion 560 of the cover 558 rotatably engages with the bearing member 622 of the front side plate 642.

(Cleaning Mechanism)

In the image forming apparatus 1, for example, the exposure means such as the optical print head 105 is provided between the charging device 104 and the developing device 106. In some instances, the light emergent surface of the lens array 506 is contaminated with toner falling from the photosensitive drum 103 or the developing device 106. In the case where the lens (lens portion 706), through which light used for image formation passes, of the plurality of lenses of the lens array 506 is contaminated with the toner, there is a liability that the light emitted from the light emitting element is partly blocked and thus a lowering in image quality of an output image is caused. For that reason, the light emergent surface of the optical print head 105 may desirably be cleaned periodically.

FIG. 12 is a schematic perspective view of a bar-like cleaning member 572 used for cleaning the light emergent surface of the lens array 506. For convenience of explanation, a longitudinal direction, a widthwise direction, a front side and a rear side are defined as shown in FIG. 12. The cleaning member 572 includes a grip portion 575 to be griped by the operator for holding the cleaning member 572. On a lower free end side of the cleaning member 572, a sliding portion 574 (not shown in FIG. 12) for sliding on and cleaning the light emergent surface of the lens array 506 is provided as described later.

A contact portion 582 is formed between the grip portion 575 and the sliding portion 574 (not shown in FIG. 12) with respect to the longitudinal direction. The contact portion 582 is a projection projecting upward from the cleaning member 572 and stands on the cleaning member 572 in a direction crossing the longitudinal direction. The contact portion 582 may be formed integrally with the cleaning member 572 and may also be formed as a separate member from the cleaning member 572.

Part (a) of FIG. 13 is a schematic perspective view of the exposure unit 500 and the cleaning member 572 immediately after the cleaning member 572 is inserted by the operator from an outside of the image forming apparatus 1 into the exposure unit 500 through an opening portion 700 for cleaning the light emergent surface of the lens array 506. As shown in part (a) of FIG. 13, cleaning of the light emergent surface of the lens array 506 is carried out in the case where the optical print head 105 is in the retracted position. In other words, the cleaning member 572 can be inserted between the optical print head 105 and the photosensitive drum 103 when the optical print head 105 is in the retracted position. The opening portion 700 is an opening formed in the first supporting portion 527, and is fixed to, for example, the front side plate 642 constituting a part of the apparatus main assembly. Further, the opening portion 700 guides the inserted sliding portion 574 of the cleaning member 572 onto the light emergent surface of the lens array 506. Although description will be made later, in a state of part (a) of FIG. 13, the sliding portion 574 contacts the light emergent surface of the lens array 506.

Parts (b) of FIG. 13 is a schematic perspective view for illustrating a state in which the contact further inserts the cleaning member 572 through the opening portion 700 from the state of part (a) of FIG. 13 and thus the contact portion 582 contacts a portion-to-be-contacted 705 formed on the front side of the opening portion 700. At this time, the cleaning member 572 is positioned between an unshown photosensitive drum 103 and the light emergent surface of the lens array 506. It becomes impossible that the cleaning member 572 further moves toward the rear side (a downstream side with respect to an inserting direction) by contact of the contact portion 582 with the portion-to-be-contacted 705. That is, the cleaning member 572 moved by the operator in the inserting direction between the photosensitive drum 103 and the optical print head 105 is caused to stop by the contact of the contact portion 582 with the portion-to-be-contacted 705 toward the inserting direction.

Further, the opening portion 700 is formed in the first supporting portion 527, and the first supporting portion 527 is fixed to the image forming apparatus 1 main assembly. For that reason, even when the contact portion 582 contacts the portion-to-be-contacted 705, impact due to the contact is not directly transmitted to the holding member 505. If the portion-to-be-contacted 705 is provided on the optical print head 105 or the drum unit 518, there is a liability that a position of the optical print head 105 or the drum unit 518 relative to the image forming apparatus 1 main assembly is deviated due to the impact when the contact portion 582 contacts the portion-to-be-contacted 705. Then, relative position between the optical print head 105 and the photosensitive drum 103 is deviated and leads to generate a cause of an image defect such as color misregistration. Accordingly, at a position where the portion-to-be-contacted 705 is provided, the portion-to-be-contacted 705 is required to be a member which is a separate member, such as the opening portion 700 or the front side plate 642, from both the optical print head 105 and the drum unit 518 and which is a member fixed to the image forming apparatus 1 main assembly.

As a means for further enhancing an effect of suppressing the impact due to the contact between the contact portion 582 and the portion-to-be-contacted 705, it is possible to cite that the portion-to-be-contacted 705 is provided at a position where the operator can visually recognize the portion-to-be-contacted 705 from the outside of the apparatus main assembly. As a result, the operator can insert the cleaning member 572 through the opening portion 700 while confirming whether or not the contact portion 582 contacts the portion-to-be-contacted 705 depending on a degree of insertion of the cleaning member 572 by the operator.

Part (a) of FIG. 14 is a perspective view of the cleaning member 572 as seen from a lower side, and part (b) of FIG. 14 is a sectional view of the cleaning member 572 cut along a plane perpendicular to a rotational axis of the photosensitive drum 103.

As shown in parts (a) and (b) of FIG. 14, the cleaning member 572 includes the sliding portion 574, engaging portions 576 and lower projected portions 577. The sliding portion 574 is provided on the free end lower side of the cleaning member 572. The sliding portion 574 is a nonwoven fabric constituted by fibers of cotton, nylon, polyester or the like, and cleans the light emergent surface of the lens array 506 by wiping off the toner or the like falling on the light emergent surface. Further, the sliding portion 574 is not limited to the nonwoven fabric but may also be a blade-like member constituted by an elastically deformable material of a silicone type, for example, so that the light emergent surface may also be cleaned by scraping off the contaminant such as the toner falling on the light emergent surface of the lens array 506.

In order to explain a function of the engaging portions 576 and the lower projected portion 577, a front side structure of the optical print head 105 will be described using FIG. 15. FIG. 15 is a schematic perspective view of the front side of the optical print head 105.

As shown in FIG. 15, on an upper side of the holding member 505, projected portions 580 extending in a rotational axis direction of the photosensitive drum 104 and projected toward the right side and the left side (in directions crossing both the rotational axis direction and an optical axis direction to of the lens) are provided and form gaps (spacings) 579. When the operator gradually inserts the cleaning member 572 through the opening portion 700, the engaging portions 576 engage in the gaps 579 and thus engage with the projected portions 580. The projected portions 580 are provided with tapered portions 581 (grayed portions in FIG. 15) at an end portion thereof on the front side of the holding member 505. Each of the tapered portions 581 inclines toward the rear side with a decreasing distance to the gap 579. By providing the tapered portions 581, the engaging portions 576 of the cleaning member 572 inserted through the opening portion 700 and moved toward the downstream side in the inserting direction are guided into the gaps 579.

Part (a) of FIG. 16 is a sectional view of the opening portion 700 in which the cleaning member 572 is inserted and which is cut along a direction perpendicular to the rotational axis of the photosensitive drum 103. As shown in part (a) of FIG. 16, the cleaning member 572 is loosely engaged with the opening portion 700 with a gap (interval) of about 0.5 mm from an inside of the opening portion 700, and is projected from moving in the direction crossing the longitudinal direction. That is, movement of the cleaning member 572 inserted through the opening portion 700 is projected by the opening portion 700 so that the cleaning member 572 is moved in the direction (front-rear direction) along the rotational axis of the photosensitive drum 103. As a result, the engaging portions 576 of the cleaning member 572 inserted through the opening portion 700 and moving toward the downstream side in the inserting direction engage with the front side end portion of the projected portions 580 (part (b) of FIG. 16) of the optical print head 105 located in the retracted position. In this state, the operator inserts and extracts the cleaning member 572 through the opening portion 700, so that the lens array 506 can be cleaned from one end side toward the other end side. Incidentally, herein, "a state in which the cleaning member 572 cleaned the lens array 506 from one end side toward the other end side" refers to "a state in which the cleaning member 572 cleaned a portion, of the light emergent surfaces of the lens array 506, through which light focused in a region used for forming the image on the photosensitive drum 103 passes."

Part (b) of FIG. 16 is a schematic view showing a cross section of the cleaning member 572, engaging in the gaps 579 of the optical print head 105, cut in a direction perpendicular to the rotational axis of the photosensitive drum 103 as seen from the front side. The lower projected portions 577 are formed along the longitudinal direction of the cleaning member 572 so as to oppose an upper side of the projected portions 580 when the cleaning member 572 is inserted through the opening portion 700. As shown in part (a) of FIG. 16, the lower projected portions 577 oppose and contact the upper side of the projected portions 580. As a result, a gap is formed between the cleaning member 572 and the light emergent surfaces of the lens array 506. That is, in the case where the operator inserts and extracts the cleaning member 572 through the opening portion 700, it is possible to prevent the lens array 506 from being damaged by contact of a portion, other than the sliding portion 574, of the cleaning member 572 with the lens array 506.

Parts (a) and (b) of FIG. 17 are schematic views for illustrating a positional relationship between the free end of the cleaning member 572 and the lens array 506 when the contact portion 582 contacts the portion-to-be-contacted 705.

As described above, light beams emitted from the LEDs (light emitting elements) 503 are focused on the photosensitive drum 103 through the lens array 506. As a result, the photosensitive drum 103 is exposed to the light beams, but all the light beams emitted from the LEDs (light emitting elements) 503 are not always used for image formation. For example, in this embodiment, an exposable range is 314 mm, but a long side length of A4-size recording paper and a short side length of A3-size recording paper are 297 mm. That is, on the photosensitive drum 103, a region actually used for the image formation is 297 mm at the maximum, so that even when a region out of the actually used region is exposed to light, such a region is not used for the image formation. As a result, even in the lens array 506 including the plurality of lenses, lenses through which the light beams focused in the region used for forming the image on the photosensitive drum 103 pass and lenses through which the light beams focused in the region which is not used for forming the image on the photosensitive drum 103 pass exist. Lenses 606 in parts (a) and (b) of FIG. 17 represent the lenses through which the light beams focused in the region used for forming the image on the photosensitive drum 103 pass.

Part (a) of FIG. 17 shows a state in which the contact portion 582 and the portion-to-be-contacted 705 are disposed so that the operator portion 582 contacts the portion-to-be-contacted 705 after the sliding portion 574 moves to a further rear side (downstream with respect to the inserting direction) than an end portion of the lens array 506 on the rear side. The sliding portion 574 moves to the further rear side than the end portion of the lens array 506 on the rear side, and therefore, the toner or the like scraped by or wiped off by the sliding portion 574 can be brushed off the light emergent surfaces of the lens array 506.

On the other hand, part (b) of FIG. 17 is a schematic view showing a state in which when the contact portion 582 contacts the portion-to-be-contacted 705, a part of the sliding portion 574 is positioned on the light emergent surface of the lens array 506. As shown in part (a) of FIG. 17, it is ideal that the sliding portion 574 moves to the further rear side (downstream side with respect to the inserting direction) than the end portion (the other end) of the lens array 506 on the rear side, but the sliding portion 574 may only be required to clean the light emergent surfaces of the lenses 606 through which the light beams are focused in the region used for the image formation. Further, if the sliding portion 574 cleans the light emergent surfaces of the lenses 606, when the contact portion 582 contacts the portion-to-be-contacted 705, the free end of the cleaning member 572 may also be positioned on a side upstream of the rear side end portion of the lens array 506 with respect to the inserting direction. As described above, in order to satisfactorily form the image on the photosensitive drum 103, it is desirable that an entire area of the light emergent surface of the lenses 606 be cleaned. However, if the user permits contamination to some extent, a constitution in which cleaning is ended at the time of the contact of the contact portion 582 with the portion-to-be-contacted 705 even when the entire area of the light emergent surfaces of the lenses 606 is not cleaned may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional application of U.S. patent application Ser. No. 16/166,511, filed Oct. 22, 2018, which claims the benefit of Japanese Patent Application No. 2017-208425 filed on Oct. 27, 2017, which is hereby incorporated by reference herein in its entirety.

What is claimed is:

1. An image forming apparatus comprising:

a photosensitive drum;

a supporting member configured to rotatably support said photosensitive drum;

a print head including a plurality of light emitting elements arranged along a rotational axis direction of said photosensitive drum and a lens configured to focus light emitted from said light emitting elements onto said photosensitive drum;

a receiving portion into which a tip of a cleaning member configured to clean said lens is inserted from an outside of said image forming apparatus in the rotational axis direction; and an abutted portion on which said cleaning member inserted into said receiving portion and moving in an inserting direction is abutted, wherein said abutted portion is positioned upstream of said lens with respect to the inserting direction and said abutted portion is provided separately from said supporting member and said print head.

2. The image forming apparatus according to claim 1, further comprising a front side plate positioned upstream of said print head with respect to the inserting direction, said front side plate been fixed to said supporting member and said abutted portion.

3. The image forming apparatus according to claim 1, wherein said abutted portion and said receiving portion are molded integrally with each other.

4. The image forming apparatus according to claim 1, further comprising a movement mechanism, wherein said movement mechanism causes said print head to move between a first position where said photosensitive drum is exposed and a second position further spaced from said photosensitive drum than the first position.

5. The image forming apparatus according to claim 4, wherein said cleaning member is insertable into said receiving portion when said print head is in the second position.

6. The image forming apparatus according to claim 4, wherein an emergent surface of said lens is a positioned closer to said photosensitive drum than said abutted portion with respect to an optical axis direction of said lens when said print head is in the first position, and is positioned further away from said photosensitive drum than said abutted portion when said print head is in the second position.

7. The image forming apparatus according to claim 1, wherein said receiving portion includes an opening into which said cleaning member is to be inserted, and said abutted portion comprises an edge of the opening.

8. The image forming apparatus according to claim 1, wherein said print head exposes said photosensitive drum to light from downstream of said photosensitive drum with respect to a vertical direction.

9. An image forming apparatus comprising:

a photosensitive drum;

a supporting member configured to rotatably support said photosensitive drum;

a print head including a plurality of light emitting elements arranged along a rotational axis direction of said photosensitive drum and a lens configured to focus light emitted from said light emitting elements onto said photosensitive drum;

a movement mechanism configured to cause said print head to move between a first position where said photosensitive drum is exposed and a second position further spaced from said photosensitive drum than the first position;

a receiving portion into which a tip of a cleaning member configured to clean said lens is inserted from an outside of said image forming apparatus in the rotational axis direction; and an abutted portion on which said cleaning member inserted into said receiving portion and moving in an inserting direction is abutted, wherein said abutted portion is provided separately from said supporting member and said print head.

10. The image forming apparatus according to claim 9, further comprising a front side plate positioned upstream of said print head with respect to the inserting direction, said front side plate been fixed with said supporting member and said abutted portion.

11. The image forming apparatus according to claim 9, wherein said cleaning member is insertable into said receiving portion when said print head is in the second position.

12. The image forming apparatus according to claim 9, wherein an emergent surface of said lens is positioned closer to said photosensitive drum than said abutted portion with respect to an optical axis direction of said lens when said print head is in the first position, and is positioned further away from said photosensitive drum than said abutted portion when said print head is in the second position.

13. The image forming apparatus according to claim 9, wherein said receiving portion includes an opening into which said cleaning member is to be inserted, and said abutted portion comprises an edge of the opening.

14. The image forming apparatus according to claim 9, wherein said print head exposes said photosensitive drum to light from downstream of said photosensitive drum with respect to a vertical direction.

15. An image forming apparatus comprising:

a frame configured to support an exchangeable drum cartridge for rotatably supporting a photosensitive drum, said frame being provided with a front side plate including an opening through which the drum cartridge passes along a rotational axis of the photosensitive drum to mount and dismount the drum cartridge;

a print head supported by said frame and including a plurality of light emitting elements arranged along the rotational axis direction and a lens configured to focus light emitted from said light emitting elements onto said photosensitive drum; and a guide member fixed to said front side plate so as to avoid a mount/dismount path of the drum cartridge and configured to guide a cleaning member toward a light emergent surface of said lens for cleaning the light emergent surface.

16. The image forming apparatus according to claim 15, wherein as viewed in the rotational axis direction, said guide member is positioned within an area of said opening.

17. The image forming apparatus according to claim 15, wherein said guide member is provided with an opening portion through which the cleaning member is inserted.

18. The image forming apparatus according to claim 15, further comprising a movement mechanism, wherein said movement mechanism causes said print head to move between a first position where said photosensitive drum is exposed and a second position further spaced from the photosensitive drum than the first position.

19. The image forming apparatus according to claim 18, wherein said print head, being moved from the first position toward the second position by said movement mechanism, is caused to stop at the second position by contact of a stopper fixed to said frame.

20. The image forming apparatus according to claim 19, wherein said stopper is formed on said guide member.

21. The image forming apparatus according to claim 18, wherein said guide member is capable of guiding said cleaning member toward the light emergent surface in a case in which said print head is positioned at the second position.

22. The image forming apparatus according to claim 18, wherein said guide member is provided with an opening portion through which said cleaning member is inserted, and wherein as viewed in the rotation axis direction, said opening portion is not overlapped with the light emergent surface in a case in which said print head is positioned at the first position and said opening portion is overlapped with the light emergent surface in a case in which said print head is positioned at the second position.

23. The image forming apparatus according to claim 15, wherein said guide member is contacted by a projection portion provided on the cleaning member and restricting an insertion length of the cleaning member.

* * * * *